US008863551B2

(12) United States Patent
de Larminat et al.

(10) Patent No.: US 8,863,551 B2
(45) Date of Patent: Oct. 21, 2014

(54) HEAT EXCHANGER

(75) Inventors: Paul de Larminat, Nantes (FR); Jeb Schreiber, Emigsville, PA (US); Jay A. Kohler, York, PA (US); John C. Hansen, Spring Grove, PA (US); Mustafa Kemal Yanik, York, PA (US); William F. McQuade, New Cumberland, PA (US); Justin Kauffman, York, PA (US); Soren Bierre Poulsen, Hojbjerg (DK); Lee Li Wang, Shanghai (CN); Satheesh Kulankara, York, PA (US)

(73) Assignee: Johnson Controls Technology Company, Holland, MI (US)

( * ) Notice: Subject to any disclaimer, the term of this patent is extended or adjusted under 35 U.S.C. 154(b) by 1136 days.

(21) Appl. No.: 12/746,858

(22) PCT Filed: Jan. 9, 2009

(86) PCT No.: PCT/US2009/030654
§ 371 (c)(1),
(2), (4) Date: Sep. 2, 2010

(87) PCT Pub. No.: WO2009/089488
PCT Pub. Date: Jul. 16, 2009

(65) Prior Publication Data

US 2010/0319395 A1 Dec. 23, 2010

Related U.S. Application Data

(60) Provisional application No. 61/020,533, filed on Jan. 11, 2008.

(51) Int. Cl.

| | |
|---|---|
| ***F25B 39/02*** | (2006.01) |
| ***F28F 25/06*** | (2006.01) |
| ***F28D 3/02*** | (2006.01) |
| ***F28D 3/04*** | (2006.01) |
| ***F28D 7/16*** | (2006.01) |
| ***F28D 21/00*** | (2006.01) |
| ***F28F 9/22*** | (2006.01) |

(52) U.S. Cl.
CPC ..... *F28F 25/06* (2013.01); *F25B 39/028* (2013.01); *F28D 3/02* (2013.01); *F28D 3/04* (2013.01); *F28D 7/16* (2013.01); *F28D 21/0017* (2013.01); *F28F 9/22* (2013.01); *F25B 2339/0242* (2013.01); *F25B 2400/13* (2013.01); *F28D 2021/0071* (2013.01); *F28F 2280/02* (2013.01)
USPC ..... 62/525

(58) Field of Classification Search
USPC ..... 62/515, 525, 527, 498; 165/159, 157
See application file for complete search history.

(56) References Cited

U.S. PATENT DOCUMENTS 939,143 A 11/1909 Lillie
1,427,430 A * 8/1922 Barbet ..... 261/122.1

(Continued)

FOREIGN PATENT DOCUMENTS

EP 0179225 A1 4/1986
EP 1030154 A2 8/2000

(Continued)

OTHER PUBLICATIONS

Witt, "Spray Evaporator—Assembly and Instructions for the BVKF Models", Nov. 1, 1998, pp. 1-11, Figures p. 2.

*Primary Examiner* — Frantz Jules
*Assistant Examiner* — Emmanuel Duke
(74) *Attorney, Agent, or Firm* — McNees Wallace & Nurick LLC

(57) ABSTRACT

An heat exchanger for use in a vapor compression system is disclosed and includes a shell, a first tube bundle, a hood and a distributor. The first tube bundle includes a plurality of tubes extending substantially horizontally in the shell. The hood covers the first tube bundle. The distributor is configured and positioned to distribute fluid onto at least one tube of the plurality of tubes.

11 Claims, 30 Drawing Sheets

(56) References Cited

U.S. PATENT DOCUMENTS

| | | | | | |
|---|---|---|---|---|---|
| 2,012,183 | A | | 8/1935 | Carrier | |
| 2,059,725 | A | * | 11/1936 | Carrier | 62/394 |
| 2,091,757 | A | | 8/1937 | Hanny | |
| 2,206,428 | A | * | 7/1940 | Reavis | 62/170 |
| 2,384,413 | A | | 9/1945 | Zwickl | |
| 2,411,097 | A | | 11/1946 | Kopp | |
| 2,492,725 | A | | 12/1949 | Ashley | |
| 2,504,710 | A | * | 4/1950 | Ludman et al. | 122/382 |
| 3,004,396 | A | | 10/1961 | Endress et al. | |
| 3,132,064 | A | | 5/1964 | Scheffers | |
| 3,180,408 | A | | 4/1965 | Grotz, Jr. et al. | |
| 3,191,396 | A | | 6/1965 | Ruddock | |
| 3,197,387 | A | | 7/1965 | Lawrance | |
| 3,213,935 | A | | 10/1965 | Reid, Jr. | |
| 3,240,265 | A | * | 3/1966 | Weller | 165/108 |
| 3,259,181 | A | | 7/1966 | Ashley et al. | |
| 3,267,693 | A | | 8/1966 | Richardson et al. | |
| 3,276,217 | A | * | 10/1966 | Bourne et al. | 62/101 |
| 3,304,742 | A | * | 2/1967 | Eisberg | 62/476 |
| 3,306,063 | A | * | 2/1967 | Weller | 62/114 |
| 3,316,735 | A | * | 5/1967 | Edberg | 62/476 |
| 3,326,280 | A | | 6/1967 | Bosquain et al. | |
| 3,351,119 | A | | 11/1967 | Rosenblad | |
| 3,412,569 | A | * | 11/1968 | Arledge, Jr. | 62/115 |
| 3,412,778 | A | | 11/1968 | Witt et al. | |
| 3,593,540 | A | * | 7/1971 | Hopkins | 62/476 |
| 3,635,040 | A | | 1/1972 | Morris, Jr. | |
| 3,735,811 | A | | 5/1973 | Moser et al. | |
| 3,775,993 | A | | 12/1973 | Murphy | |
| 3,831,390 | A | | 8/1974 | Hopkins | |
| 3,849,232 | A | | 11/1974 | Kessler et al. | |
| 4,154,642 | A | | 5/1979 | Mattern et al. | |
| 4,158,295 | A | | 6/1979 | Sibley | |
| 4,437,322 | A | * | 3/1984 | Ertinger | 62/504 |
| 4,511,432 | A | | 4/1985 | Sephton | |
| 4,520,866 | A | | 6/1985 | Nakajima et al. | |
| 4,568,022 | A | | 2/1986 | Scrivnor | |
| 4,706,741 | A | | 11/1987 | Bolmstedt et al. | |
| 4,918,944 | A | | 4/1990 | Takahashi et al. | |
| 4,944,839 | A | | 7/1990 | Rosenblad | |
| 4,972,903 | A | | 11/1990 | Kwok | |
| 4,977,861 | A | | 12/1990 | Charbonnel et al. | |
| 5,044,427 | A | | 9/1991 | Love et al. | |
| 5,059,226 | A | | 10/1991 | Schneider et al. | |
| 5,086,621 | A | | 2/1992 | Starner et al. | |
| 5,246,541 | A | | 9/1993 | Ryham | |
| 5,419,155 | A | | 5/1995 | Boehde et al. | |
| 5,461,883 | A | | 10/1995 | Terasaki | |
| 5,481,887 | A | | 1/1996 | Terasaki | |
| 5,561,987 | A | | 10/1996 | Hartfield et al. | |
| 5,575,889 | A | | 11/1996 | Rosenblad | |
| 5,588,596 | A | | 12/1996 | Hartfield et al. | |
| 5,638,691 | A | | 6/1997 | Hartfield et al. | |
| 5,645,124 | A | | 7/1997 | Hartfield et al. | |
| 5,791,404 | A | | 8/1998 | Bailey et al. | |
| 5,809,794 | A | | 9/1998 | Sibik et al. | |
| 5,839,294 | A | | 11/1998 | Chiang et al. | |
| 5,849,148 | A | | 12/1998 | Walker | |
| 5,922,903 | A | | 7/1999 | Pujado | |
| 5,931,020 | A | | 8/1999 | Nakamura | |
| 6,035,651 | A | | 3/2000 | Carey | |
| 6,089,312 | A | | 7/2000 | Biar et al. | |
| 6,127,571 | A | | 10/2000 | Mulvaney, III | |
| 6,167,713 | B1 | | 1/2001 | Hartfield et al. | |
| 6,170,286 | B1 | | 1/2001 | Keuper | |
| 6,233,967 | B1 | | 5/2001 | Seewald et al. | |
| 6,253,571 | B1 | | 7/2001 | Fujii et al. | |
| 6,293,112 | B1 | | 9/2001 | Moeykens et al. | |
| 6,341,492 | B1 | | 1/2002 | Carey | |
| 6,357,239 | B2 | | 3/2002 | Carey | |
| 6,357,254 | B1 | | 3/2002 | Xia | |
| 6,516,627 | B2 | | 2/2003 | Ring et al. | |
| 6,532,763 | B1 | | 3/2003 | Gupte | |
| 6,596,244 | B1 | | 7/2003 | Pujado | |
| 6,606,882 | B1 | | 8/2003 | Gupte | |
| 6,695,043 | B1 | | 2/2004 | Wagner et al. | |
| 6,742,347 | B1 | | 6/2004 | Kolk et al. | |
| 6,748,763 | B2 | | 6/2004 | Schweigert et al. | |
| 6,749,817 | B1 | | 6/2004 | Mulvaney, III | |
| 6,830,099 | B2 | | 12/2004 | Moeykens | |
| 6,830,654 | B1 | | 12/2004 | Salmisuo | |
| 6,868,695 | B1 | * | 3/2005 | Dingel et al. | 62/515 |
| 2002/0007639 | A1 | | 1/2002 | Carey | |
| 2002/0137874 | A1 | | 9/2002 | Hucks et al. | |
| 2002/0162352 | A1 | | 11/2002 | Ring et al. | |
| 2003/0230105 | A1 | | 12/2003 | Lee | |
| 2004/0112573 | A1 | | 6/2004 | Moeykens | |
| 2004/0155369 | A1 | * | 8/2004 | Kinney et al. | 261/110 |
| 2004/0245084 | A1 | | 12/2004 | Bethge | |
| 2006/0080998 | A1 | * | 4/2006 | De Larminat et al. | 62/515 |
| 2008/0148767 | A1 | | 6/2008 | de Larminat et al. | |
| 2008/0149311 | A1 | | 6/2008 | Liu et al. | |
| 2011/0017432 | A1 | | 1/2011 | Kulankara et al. | |

FOREIGN PATENT DOCUMENTS

| | | | |
|---|---|---|---|
| GB | 2161256 | A | 1/1986 |
| JP | S52136449 | A | 11/1977 |
| JP | 56-155666 | A | 12/1981 |
| JP | 5752768 | A | 3/1982 |
| JP | 61-192177 | U | 11/1986 |
| JP | 62162868 | A | 7/1987 |
| JP | 01070696 | A | 3/1989 |
| JP | 07083539 | A | 3/1995 |
| JP | 08-233407 | A | 9/1996 |
| JP | 11-051593 | A | 2/1999 |
| JP | 2003065631 | A | 3/2003 |
| JP | 2008516187 | A | 5/2008 |
| WO | 9905463 | A1 | 2/1999 |
| WO | 2006044448 | A2 | 4/2006 |
| WO | 2007032220 | A1 | 3/2007 |

* cited by examiner

HEAT EXCHANGER

CROSS-REFERENCE TO RELATED APPLICATIONS

This application claims priority from and the benefit of U.S. Provisional Application No. 61/020,533, entitled FALLING FILM EVAPORATOR SYSTEMS, filed Jan. 11, 2008, which is hereby incorporated by reference.

BACKGROUND

The application relates generally to heat exchangers.

Conventional chilled liquid systems used in heating, ventilation and air conditioning systems include an evaporator to effect or implement a transfer of thermal energy between the refrigerant of the system and another fluid, generally a liquid to be cooled. One type of evaporator includes a shell with a plurality of tubes forming a tube bundle(s) inside the shell. The fluid to be cooled is circulated inside the tubes and the refrigerant is brought into contact with the outer or exterior surfaces of the tubes, resulting in a transfer of thermal energy between the fluid to be cooled and the refrigerant. The heat transferred to the refrigerant from the fluid to be cooled causes the refrigerant to undergo a phase change to a vapor, that is, the refrigerant is boiled on the outside of the tubes. For example, refrigerant can be deposited onto the exterior surfaces of the tubes by spraying or other similar techniques in what is commonly referred to as a "falling film" evaporator. In a further example, the exterior surfaces of the tubes can be fully or partially immersed in liquid refrigerant in what is commonly referred to as a "flooded" evaporator. In yet another example, a portion of the tubes can have refrigerant deposited on the exterior surfaces and another portion of the tube bundle can be immersed in liquid refrigerant in what is commonly referred to as a "hybrid falling film" evaporator.

As a result of the transfer of thermal energy from the fluid being cooled, the refrigerant is heated and converted to a vapor state, which is then returned to a compressor where the vapor is compressed, to begin another refrigerant cycle. The cooled fluid can be circulated to a plurality of heat exchangers located throughout a building. Warmer air from the building is passed over the heat exchangers where the cooled fluid is warmed while cooling the air for the building. The fluid warmed by the building air is returned to the evaporator to repeat the process.

SUMMARY

The present invention relates to a heat exchanger for use in a vapor compression system including a shell, a first tube bundle, a hood and a distributor. The first tube bundle includes a plurality of tubes extending substantially horizontally in the shell, the hood covering the first tube bundle. The distributor is configured and positioned to distribute fluid onto at least one tube of the plurality of tubes.

The present invention also relates to an evaporator for use in a refrigeration system including a shell, an outlet formed in the shell, a plurality of tube bundles, a plurality of hoods, a gap between adjacent hoods of the plurality of hoods and a plurality of distributors. Each tube bundle of the plurality of tube bundles includes a plurality of tubes extending substantially horizontally in the shell. At least each hood of the plurality of hoods covers a tube bundle of the plurality of tube bundles. Each distributor of the plurality of distributors is configured and positioned to distribute fluid onto at least one tube of a tube bundle covered by a hood. The gap is configured to guide fluid exiting adjacent hoods of the plurality of hoods to the outlet.

DETAILED DESCRIPTION OF THE EXEMPLARY EMBODIMENTS

Figure 1:
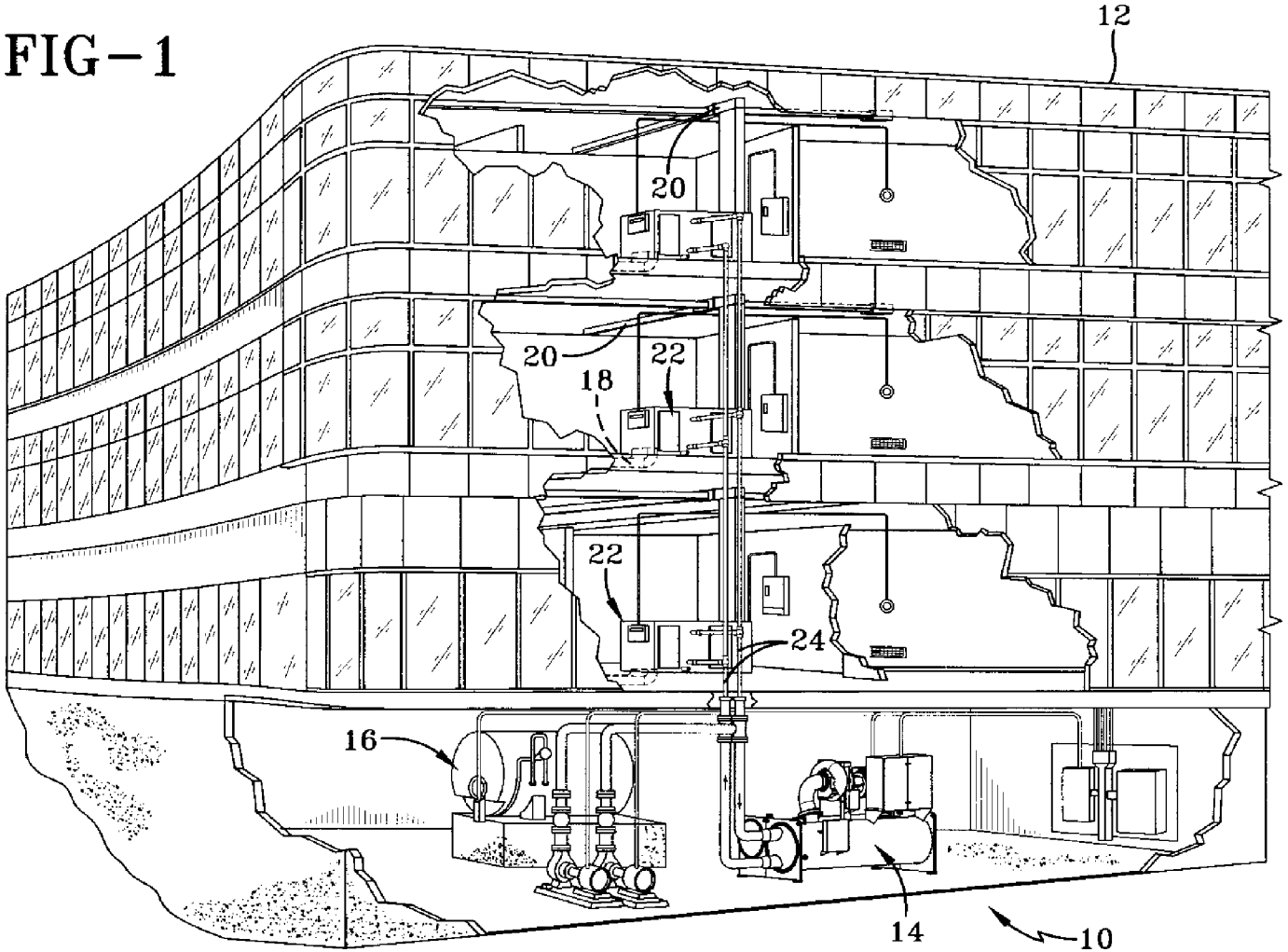
FIG. 1 shows an exemplary embodiment for a heating, ventilation and air conditioning system in a commercial setting.

FIG. 1 shows an exemplary environment for a heating, ventilation and air conditioning (HVAC) system 10 incorporating a chilled liquid system in a building 12 for a typical commercial setting. System 10 can include a vapor compression system 14 that can supply a chilled liquid which may be used to cool building 12. System 10 can include a boiler 16 to supply heated liquid that may be used to heat building 12, and an air distribution system which circulates air through building 12. The air distribution system can also include an air return duct 18, an air supply duct 20 and an air handler 22. Air handler 22 can include a heat exchanger that is connected to boiler 16 and vapor compression system 14 by conduits 24. The heat exchanger in air handler 22 may receive either heated liquid from boiler 16 or chilled liquid from vapor compression system 14, depending on the mode of operation of system 10. System 10 is shown with a separate air handler on each floor of building 12, but it is appreciated that the components may be shared between or among floors.

Figure 2:
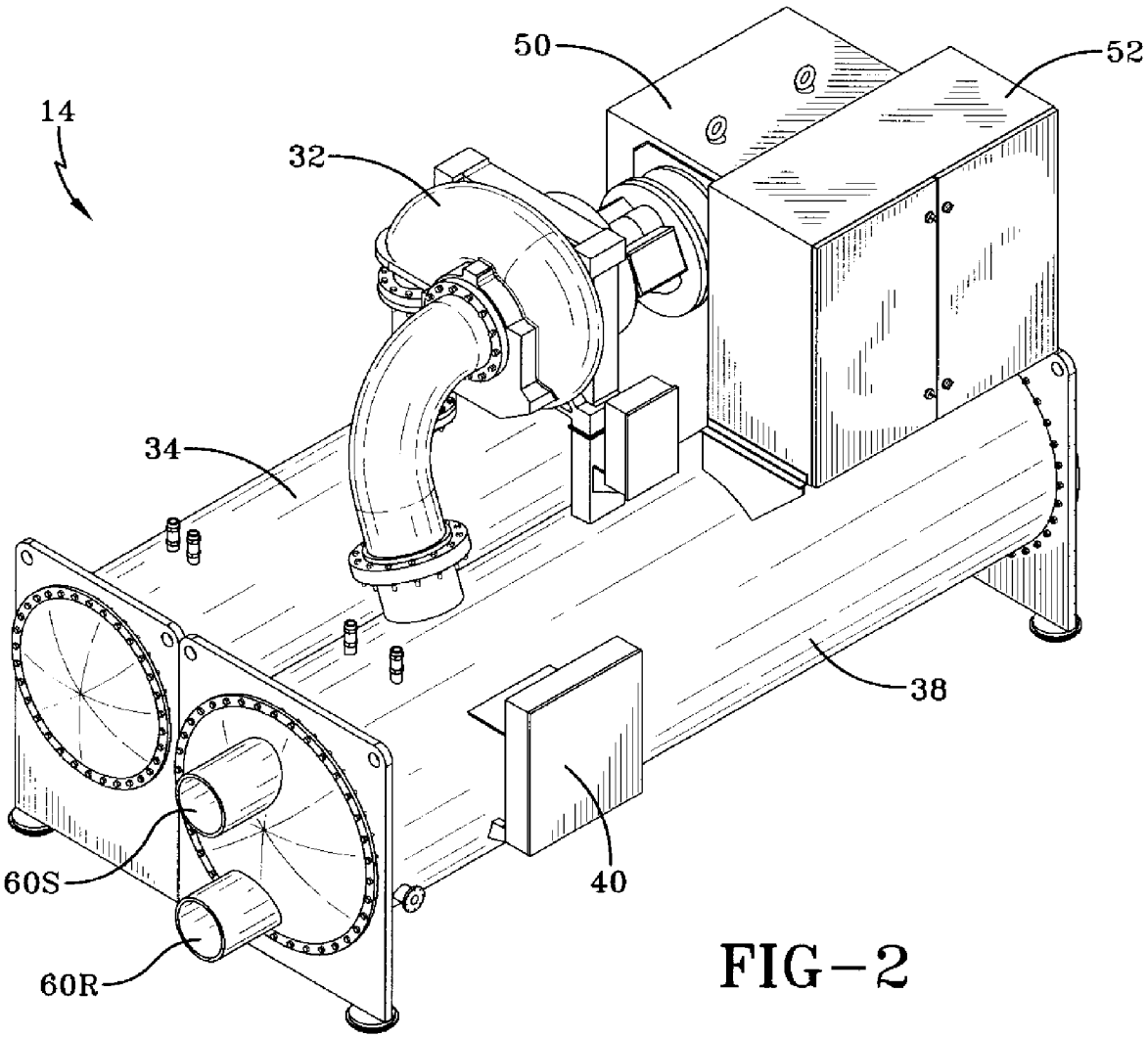
FIG. 2 shows an isometric view of an exemplary vapor compression system.
Figure 3:
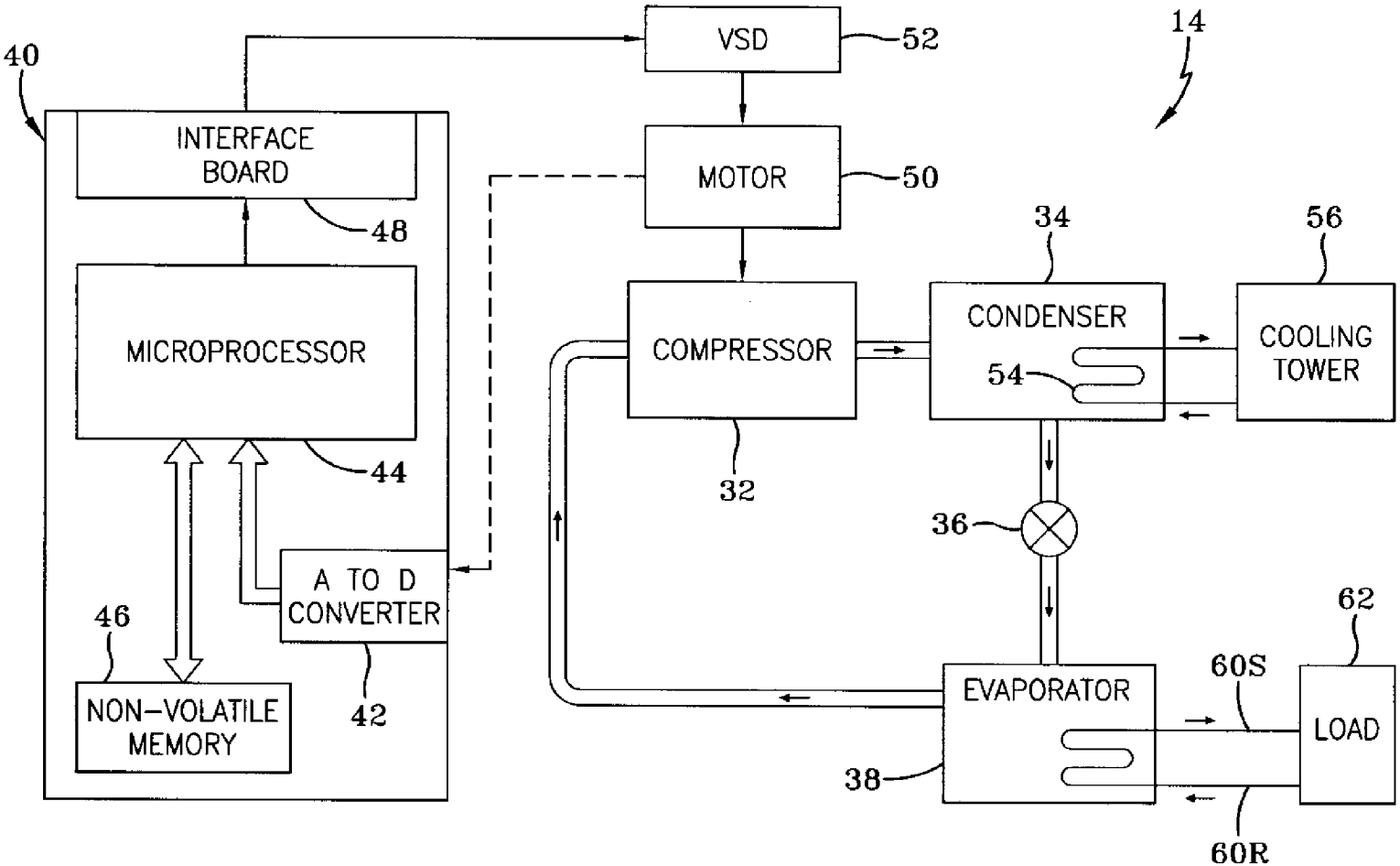
FIGS. 3 and 4 schematically illustrate exemplary embodiments of a vapor compression system.

FIGS. 2 and 3 show an exemplary vapor compression system 14 that can be used in an HVAC system, such as HVAC system 10. Vapor compression system 14 can circulate a refrigerant through a compressor 32 driven by a motor 50, a condenser 34, expansion device(s) 36, and a liquid chiller or evaporator 38. Vapor compression system 14 can also include a control panel 40 that can include an analog to digital (A/D) converter 42, a microprocessor 44, a non-volatile memory 46, and an interface board 48. Some examples of fluids that may be used as refrigerants in vapor compression system 14 are hydrofluorocarbon (HFC) based refrigerants, for example, R-410A, R-407, R-134a, hydrofluoro olefin (HFO), "natural" refrigerants like ammonia ($NH_3$), R-717, carbon dioxide ($CO_2$), R-744, or hydrocarbon based refrigerants, water vapor or any other suitable type of refrigerant. In an exemplary embodiment, vapor compression system 14 may use one or more of each of VSDs 52, motors 50, compressors 32, condensers 34 and/or evaporators 38.

Motor 50 used with compressor 32 can be powered by a variable speed drive (VSD) 52 or can be powered directly from an alternating current (AC) or direct current (DC) power source. VSD 52, if used, receives AC power having a particular fixed line voltage and fixed line frequency from the AC power source and provides power having a variable voltage and frequency to motor 50. Motor 50 can include any type of electric motor that can be powered by a VSD or directly from an AC or DC power source. For example, motor 50 can be a switched reluctance motor, an induction motor, an electronically commutated permanent magnet motor or any other suitable motor type. In an alternate exemplary embodiment, other drive mechanisms such as steam or gas turbines or engines and associated components can be used to drive compressor 32.

Compressor 32 compresses a refrigerant vapor and delivers the vapor to condenser 34 through a discharge line. Compressor 32 can be a centrifugal compressor, screw compressor, reciprocating compressor, rotary compressor, swing link compressor, scroll compressor, turbine compressor, or any other suitable compressor. The refrigerant vapor delivered by compressor 32 to condenser 34 transfers heat to a fluid, for example, water or air. The refrigerant vapor condenses to a refrigerant liquid in condenser 34 as a result of the heat transfer with the fluid. The liquid refrigerant from condenser 34 flows through expansion device 36 to evaporator 38. In the exemplary embodiment shown in FIG. 3, condenser 34 is water cooled and includes a tube bundle 54 connected to a cooling tower 56.

The liquid refrigerant delivered to evaporator 38 absorbs heat from another fluid, which may or may not be the same type of fluid used for condenser 34, and undergoes a phase change to a refrigerant vapor. In the exemplary embodiment shown in FIG. 3, evaporator 38 includes a tube bundle having a supply line 60S and a return line 60R connected to a cooling load 62. A process fluid, for example, water, ethylene glycol, calcium chloride brine, sodium chloride brine, or any other suitable liquid, enters evaporator 38 via return line 60R and exits evaporator 38 via supply line 60S. Evaporator 38 chills the temperature of the process fluid in the tubes. The tube bundle in evaporator 38 can include a plurality of tubes and a plurality of tube bundles. The vapor refrigerant exits evaporator 38 and returns to compressor 32 by a suction line to complete the cycle.

Figure 4:
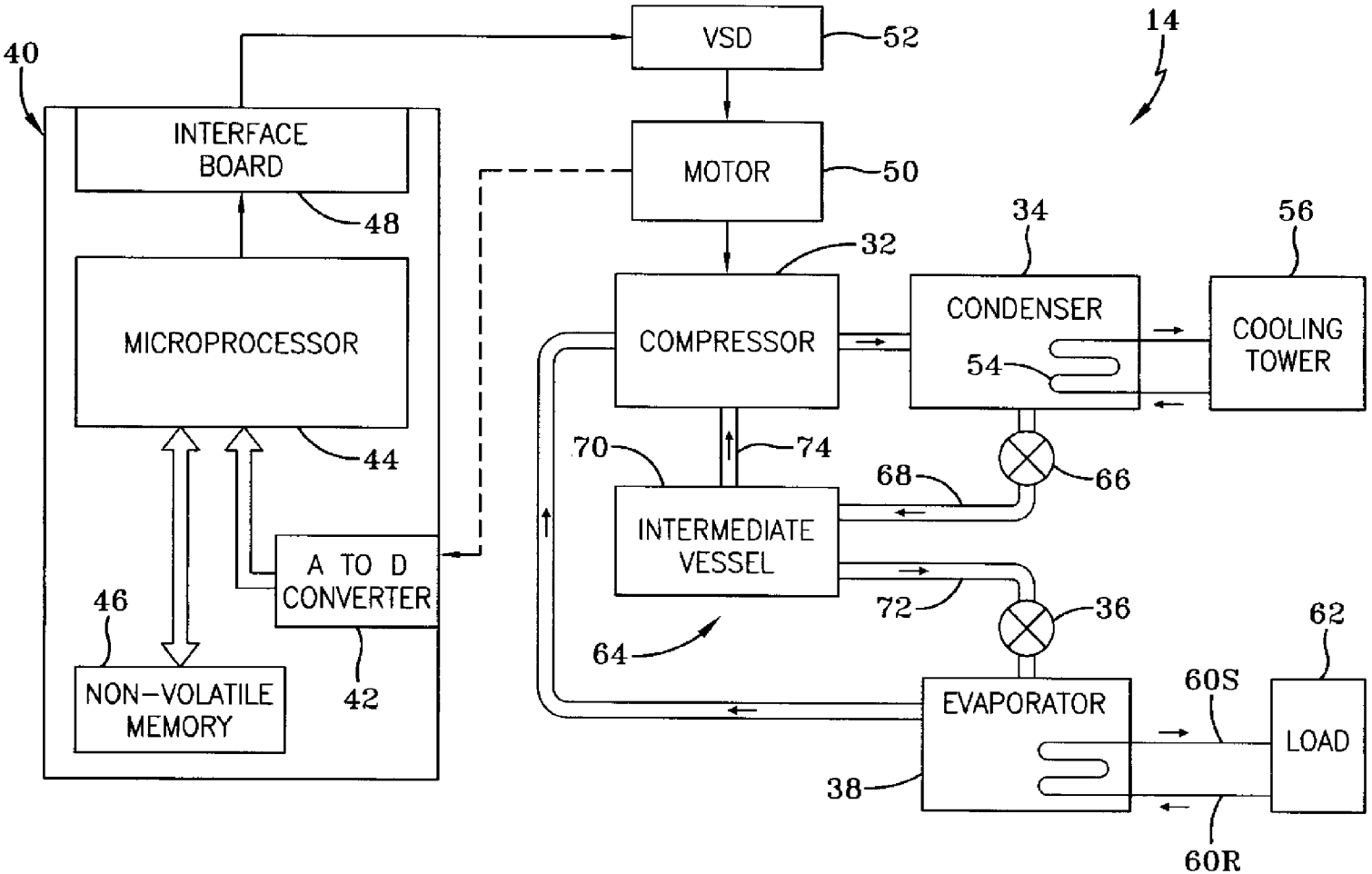

FIG. 4, which is similar to FIG. 3, shows the refrigerant circuit with an intermediate circuit 64 that may be incorporated between condenser 34 and expansion device 36 to provide increased cooling capacity, efficiency and performance. Intermediate circuit 64 has an inlet line 68 that can be either connected directly to or can be in fluid communication with condenser 34. As shown, inlet line 68 includes an expansion device 66 positioned upstream of an intermediate vessel 70. Intermediate vessel 70 can be a flash tank, also referred to as a flash intercooler, in an exemplary embodiment. In an alternate exemplary embodiment, intermediate vessel 70 can be configured as a heat exchanger or a "surface economizer". In the flash intercooler arrangement, a first expansion device 66 operates to lower the pressure of the liquid received from condenser 34. During the expansion process in a flash intercooler, a portion of the liquid is evaporated. Intermediate vessel 70 may be used to separate the evaporated vapor from the liquid received from the condenser. The evaporated liquid may be drawn by compressor 32 to a port at a pressure intermediate between suction and discharge or at an intermediate stage of compression, through a line 74. The liquid that is not evaporated is cooled by the expansion process, and collects at the bottom of intermediate vessel 70, where the liquid is recovered to flow to the evaporator 38, through a line 72 comprising a second expansion device 36.

In the "surface intercooler" arrangement, the implementation is slightly different, as known to those skilled in the art. Intermediate circuit 64 can operate in a similar matter to that described above, except that instead of receiving the entire amount of refrigerant from condenser 34, as shown in FIG. 4, intermediate circuit 64 receives only a portion of the refrigerant from condenser 34 and the remaining refrigerant proceeds directly to expansion device 36.

Figure 5A:
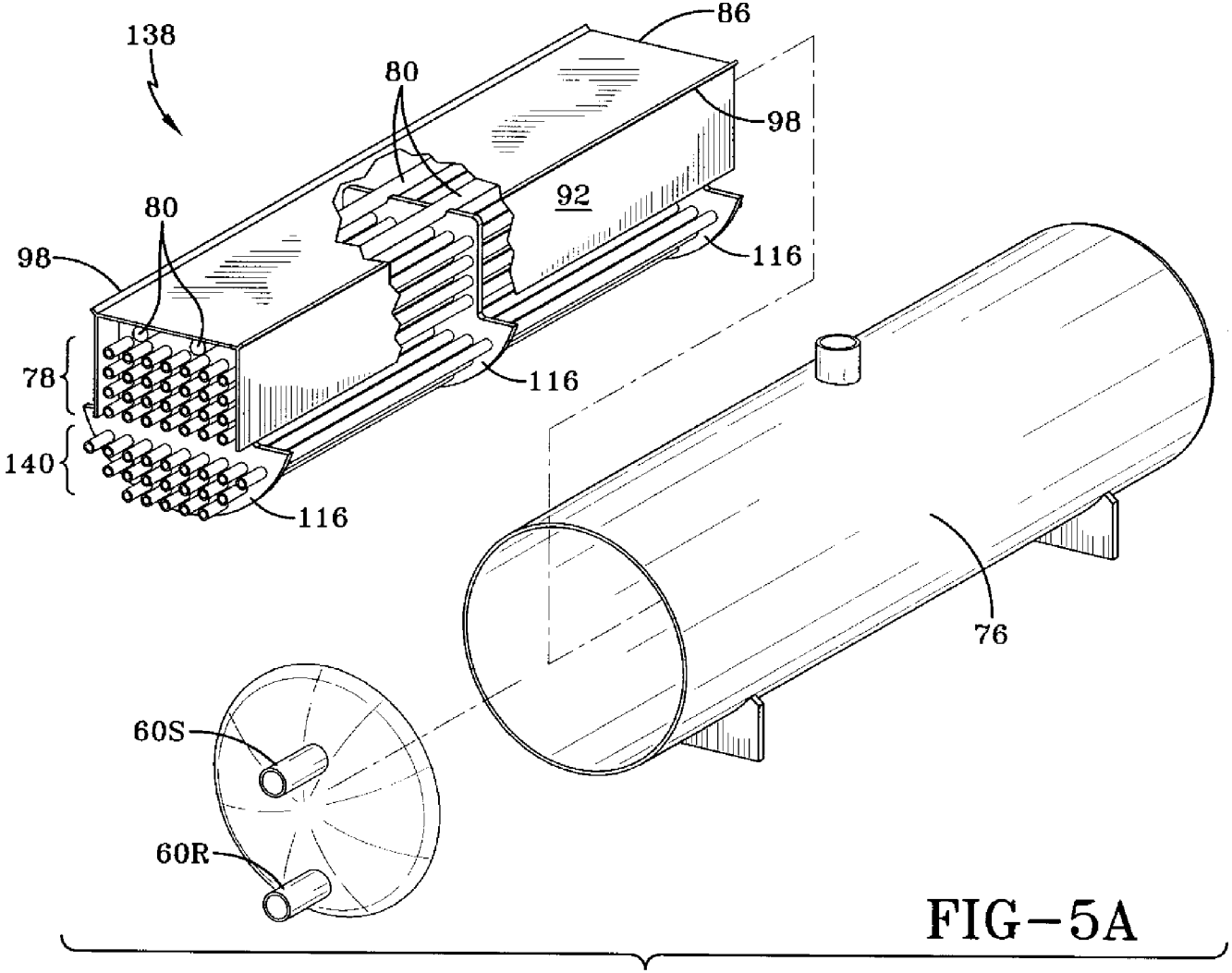
FIG. 5A shows an exploded, partial cutaway view of an exemplary evaporator.
Figure 5B:
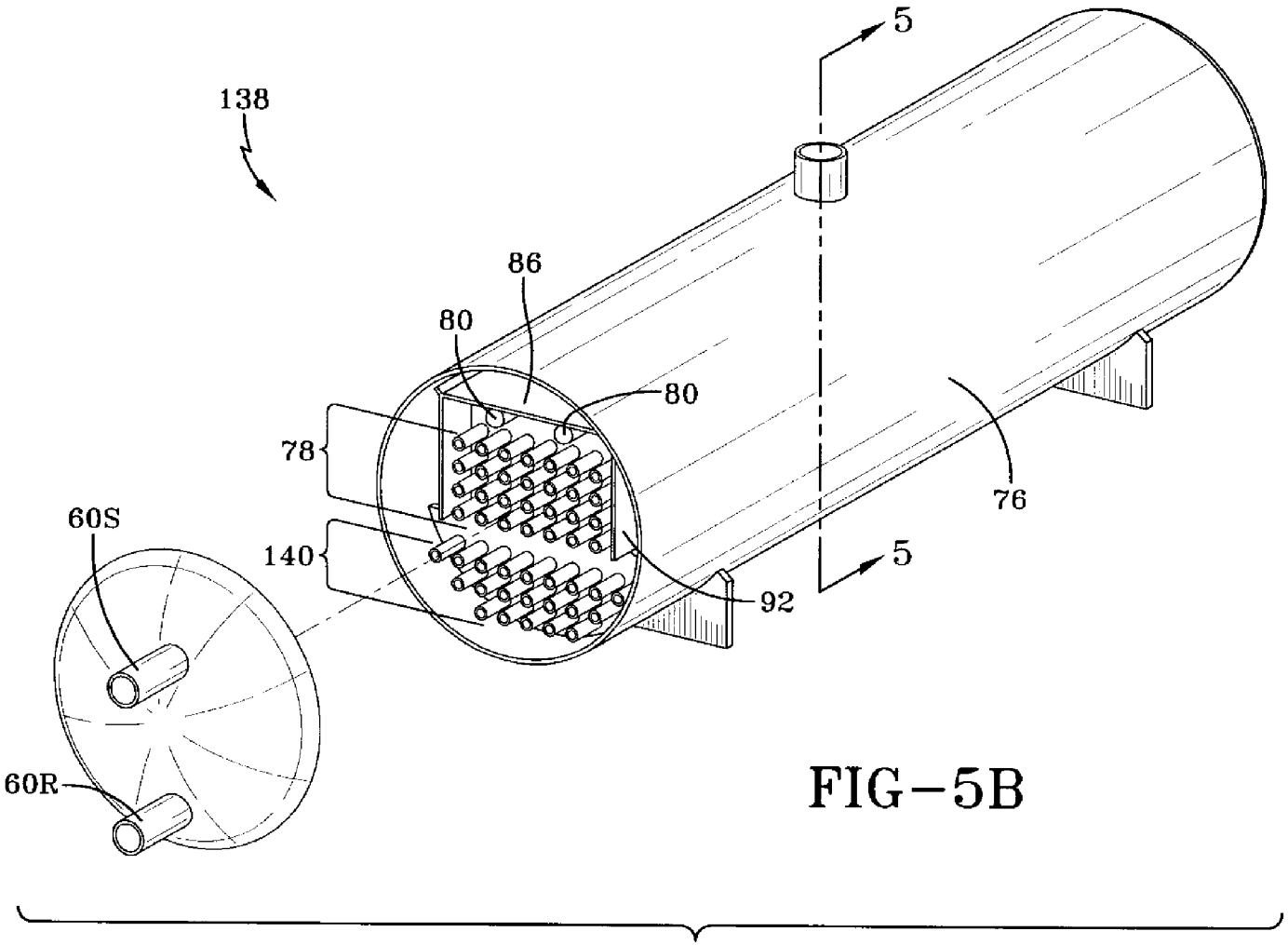
FIG. 5B shows a top isometric view of the evaporator of FIG. 5A.
Figure 5C:
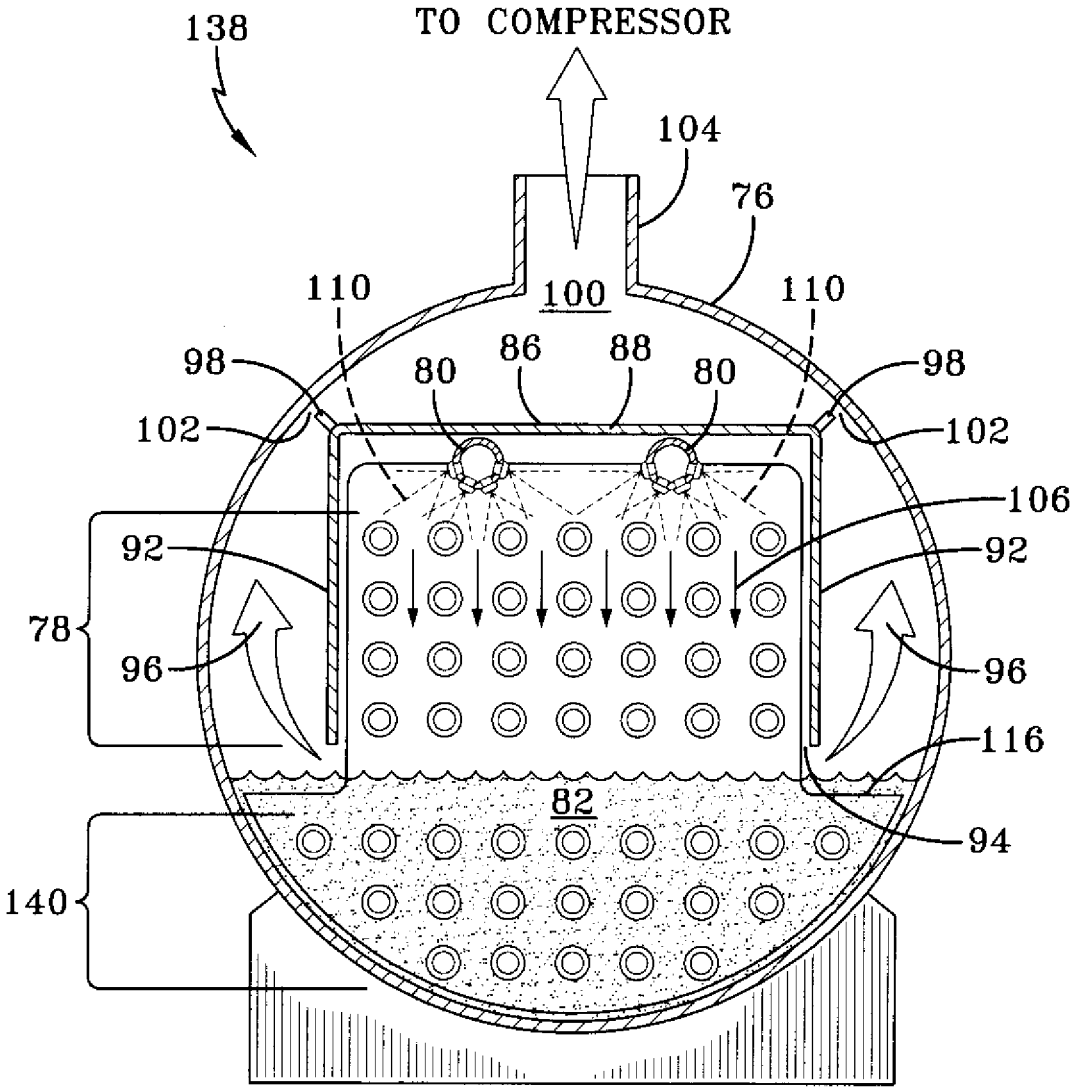
FIG. 5C shows a cross section of the evaporator, with refrigerant, taken along line 5-5 of FIG. 5B.

FIGS. 5A through 5C show an exemplary embodiment of an evaporator configured as a "hybrid falling film" evaporator. As shown in FIGS. 5A through 5C, an evaporator 138 includes a substantially cylindrical shell 76 with a plurality of tubes forming a tube bundle 78 extending substantially horizontally along the length of shell 76. At least one support 116 may be positioned inside shell 76 to support the plurality of tubes in tube bundle 78. A suitable fluid, such as water, ethylene, ethylene glycol, or calcium chloride brine flows through the tubes of tube bundle 78. A distributor 80 positioned above tube bundle 78 distributes, deposits or applies refrigerant 110 from a plurality of positions onto the tubes in tube bundle 78. In one exemplary embodiment, the refrigerant deposited by distributor 80 can be entirely liquid refrigerant, although in another exemplary embodiment, the refrigerant deposited by distributor 80 can include both liquid refrigerant and vapor refrigerant.

Liquid refrigerant that flows around the tubes of tube bundle 78 without changing state collects in the lower portion of shell 76. The collected liquid refrigerant can form a pool or reservoir of liquid refrigerant 82. The deposition positions from distributor 80 can include any combination of longitudinal or lateral positions with respect to tube bundle 78. In another exemplary embodiment, deposition positions from distributor 80 are not limited to ones that deposit onto the upper tubes of tube bundle 78. Distributor 80 may include a plurality of nozzles supplied by a dispersion source of the refrigerant. In an exemplary embodiment, the dispersion source is a tube connecting a source of refrigerant, such as condenser 34. Nozzles include spraying nozzles, but also include machined openings that can guide or direct refrigerant onto the surfaces of the tubes. The nozzles may apply refrigerant in a predetermined pattern, such as a jet pattern, so that the upper row of tubes of tube bundle 78 are covered. The tubes of tube bundle 78 can be arranged to promote the flow of refrigerant in the form of a film around the tube surfaces, the liquid refrigerant coalescing to form droplets or in some instances, a curtain or sheet of liquid refrigerant at the bottom of the tube surfaces. The resulting sheeting promotes wetting of the tube surfaces which enhances the heat transfer efficiency between the fluid flowing inside the tubes of tube bundle 78 and the refrigerant flowing around the surfaces of the tubes of tube bundle 78.

In the pool of liquid refrigerant 82, a tube bundle 140 can be immersed or at least partially immersed, to provide additional thermal energy transfer between the refrigerant and the process fluid to evaporate the pool of liquid refrigerant 82. In an exemplary embodiment, tube bundle 78 can be positioned at least partially above (that is, at least partially overlying) tube bundle 140. In one exemplary embodiment, evaporator 138 incorporates a two pass system, in which the process fluid that is to be cooled first flows inside the tubes of tube bundle 140 and then is directed to flow inside the tubes of tube bundle 78 in the opposite direction to the flow in tube bundle 140. In the second pass of the two pass system, the temperature of the fluid flowing in tube bundle 78 is reduced, thus requiring a lesser amount of heat transfer with the refrigerant flowing over the surfaces of tube bundle 78 to obtain a desired temperature of the process fluid.

It is to be understood that although a two pass system is described in which the first pass is associated with tube bundle 140 and the second pass is associated with tube bundle 78, other arrangements are contemplated. For example, evaporator 138 can incorporate a one pass system where the process fluid flows through both tube bundle 140 and tube bundle 78 in the same direction. Alternatively, evaporator 138 can incorporate a three pass system in which two passes are associated with tube bundle 140 and the remaining pass associated with tube bundle 78, or in which one pass is associated with tube bundle 140 and the remaining two passes are associated with tube bundle 78. Further, evaporator 138 can incorporate an alternate two pass system in which one pass is associated with both tube bundle 78 and tube bundle 140, and the second pass is associated with both tube bundle 78 and tube bundle 140. In one exemplary embodiment, tube bundle 78 is positioned at least partially above tube bundle 140, with a gap separating tube bundle 78 from tube bundle 140. In a further exemplary embodiment, hood 86 overlies tube bundle 78, with hood 86 extending toward and terminating near the gap. In summary, any number of passes in which each pass can be associated with one or both of tube bundle 78 and tube bundle 140 is contemplated.

An enclosure or hood 86 is positioned over tube bundle 78 to substantially prevent cross flow, that is, a lateral flow of vapor refrigerant or liquid and vapor refrigerant 106 between the tubes of tube bundle 78. Hood 86 is positioned over and laterally borders tubes of tube bundle 78. Hood 86 includes an upper end 88 positioned near the upper portion of shell 76. Distributor 80 can be positioned between hood 86 and tube bundle 78. In yet a further exemplary embodiment, distributor 80 may be positioned near, but exterior of, hood 86, so that distributor 80 is not positioned between hood 86 and tube bundle 78. However, even though distributor 80 is not positioned between hood 86 and tube bundle 78, the nozzles of distributor 80 are still configured to direct or apply refrigerant onto surfaces of the tubes. Upper end 88 of hood 86 is configured to substantially prevent the flow of applied refrigerant 110 and partially evaporated refrigerant, that is, liquid and/or vapor refrigerant 106 from flowing directly to outlet 104. Instead, applied refrigerant 110 and refrigerant 106 are constrained by hood 86, and, more specifically, are forced to travel downward between walls 92 before the refrigerant can exit through an open end 94 in the hood 86. Flow of vapor refrigerant 96 around hood 86 also includes evaporated refrigerant flowing away from the pool of liquid refrigerant 82.

It is to be understood that at least the above-identified, relative terms are non-limiting as to other exemplary embodiments in the disclosure. For example, hood 86 may be rotated with respect to the other evaporator components previously discussed, that is, hood 86, including walls 92, is not limited to a vertical orientation. Upon sufficient rotation of hood 86 about an axis substantially parallel to the tubes of tube bundle 78, hood 86 may no longer be considered "positioned over" nor to "laterally border" tubes of tube bundle 78. Similarly, "upper" end 88 of hood 86 may no longer be near "an upper portion" of shell 76, and other exemplary embodiments are not limited to such an arrangement between the hood and the shell. In an exemplary embodiment, hood 86 terminates after covering tube bundle 78, although in another exemplary embodiment, hood 86 further extends after covering tube bundle 78.

After hood 86 forces refrigerant 106 downward between walls 92 and through open end 94, the vapor refrigerant undergoes an abrupt change in direction before traveling in the space between shell 76 and walls 92 from the lower portion of shell 76 to the upper portion of shell 76. Combined with the effect of gravity, the abrupt directional change in flow results in a proportion of any entrained droplets of refrigerant colliding with either liquid refrigerant 82 or shell 76, thereby removing those droplets from the flow of vapor refrigerant 96. Also, refrigerant mist traveling along the length of hood 86 between walls 92 is coalesced into larger drops that are more easily separated by gravity, or maintained sufficiently near or in contact with tube bundle 78, to permit evaporation of the refrigerant mist by heat transfer with the tube bundle. As a result of the increased drop size, the efficiency of liquid separation by gravity is improved, permitting an increased upward velocity of vapor refrigerant 96 flowing through the evaporator in the space between walls 92 and shell 76. Vapor refrigerant 96, whether flowing from open end 94 or from the pool of liquid refrigerant 82, flows over a pair of extensions 98 protruding from walls 92 near upper end 88 and into a channel 100. Vapor refrigerant 96 enters into channel 100 through slots 102, which is the space between the ends of extensions 98 and shell 76, before exiting evaporator 138 at an outlet 104. In another exemplary embodiment, vapor refrigerant 96 can enter into channel 100 through openings or apertures formed in extensions 98, instead of slots 102. In yet another exemplary embodiment, slots 102 can be formed by the space between hood 86 and shell 76, that is, hood 86 does not include extensions 98.

Stated another way, once refrigerant 106 exits from hood 86, vapor refrigerant 96 then flows from the lower portion of shell 76 to the upper portion of shell 76 along the prescribed passageway. In an exemplary embodiment, the passageways can be substantially symmetric between the surfaces of hood 86 and shell 76 prior to reaching outlet 104. In an exemplary embodiment, baffles, such as extensions 98 are provided near the evaporator outlet to prevent a direct path of vapor refrigerant 96 to the compressor inlet.

In one exemplary embodiment, hood 86 includes opposed substantially parallel walls 92. In another exemplary embodiment, walls 92 can extend substantially vertically and terminate at open end 94, that is located substantially opposite upper end 88. Upper end 88 and walls 92 are closely positioned near the tubes of tube bundle 78, with walls 92 extending toward the lower portion of shell 76 so as to substantially laterally border the tubes of tube bundle 78. In an exemplary embodiment, walls 92 may be spaced between about 0.02 inch (0.5 mm) and about 0.8 inch (20 mm) from the tubes in tube bundle 78. In a further exemplary embodiment, walls 92 may be spaced between about 0.1 inch (3 mm) and about 0.2 inch (5 mm) from the tubes in tube bundle 78. However, spacing between upper end 88 and the tubes of tube bundle 78 may be significantly greater than 0.2 inch (5 mm), in order to provide sufficient spacing to position distributor 80 between the tubes and the upper end of the hood. In an exemplary embodiment in which walls 92 of hood 86 are substantially parallel and shell 76 is cylindrical, walls 92 may also be symmetric about a central vertical plane of symmetry of the shell bisecting the space separating walls 92. In other exemplary embodiments, walls 92 need not extend vertically past the lower tubes of tube bundle 78, nor do walls 92 need to be planar, as walls 92 may be curved or have other non-planar shapes. Regardless of the specific construction, hood 86 is configured to channel refrigerant 106 within the confines of walls 92 through open end 94 of hood 86.

Figure 6A:
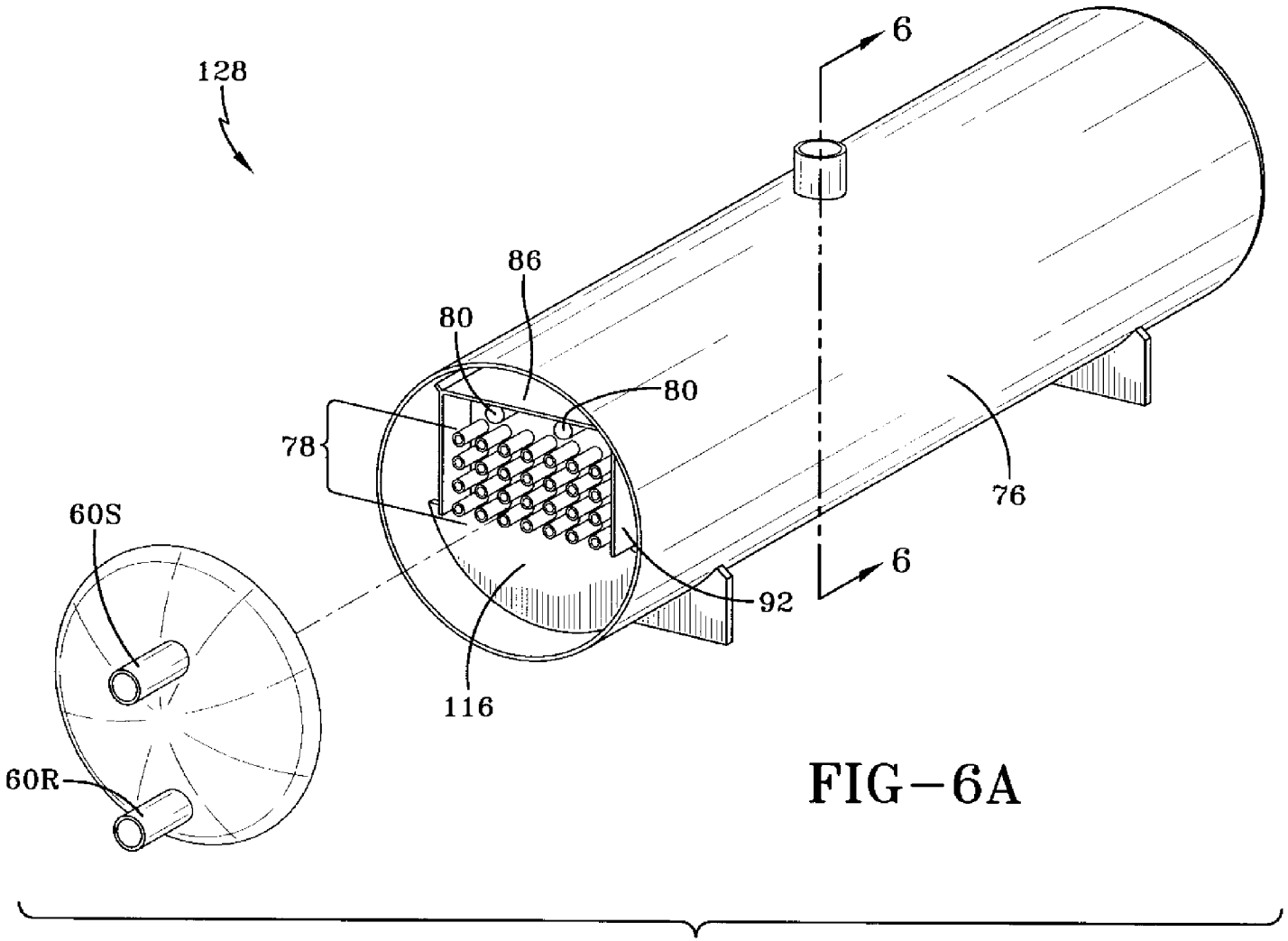
FIG. 6A shows a top isometric view of an exemplary evaporator.
Figure 6B:
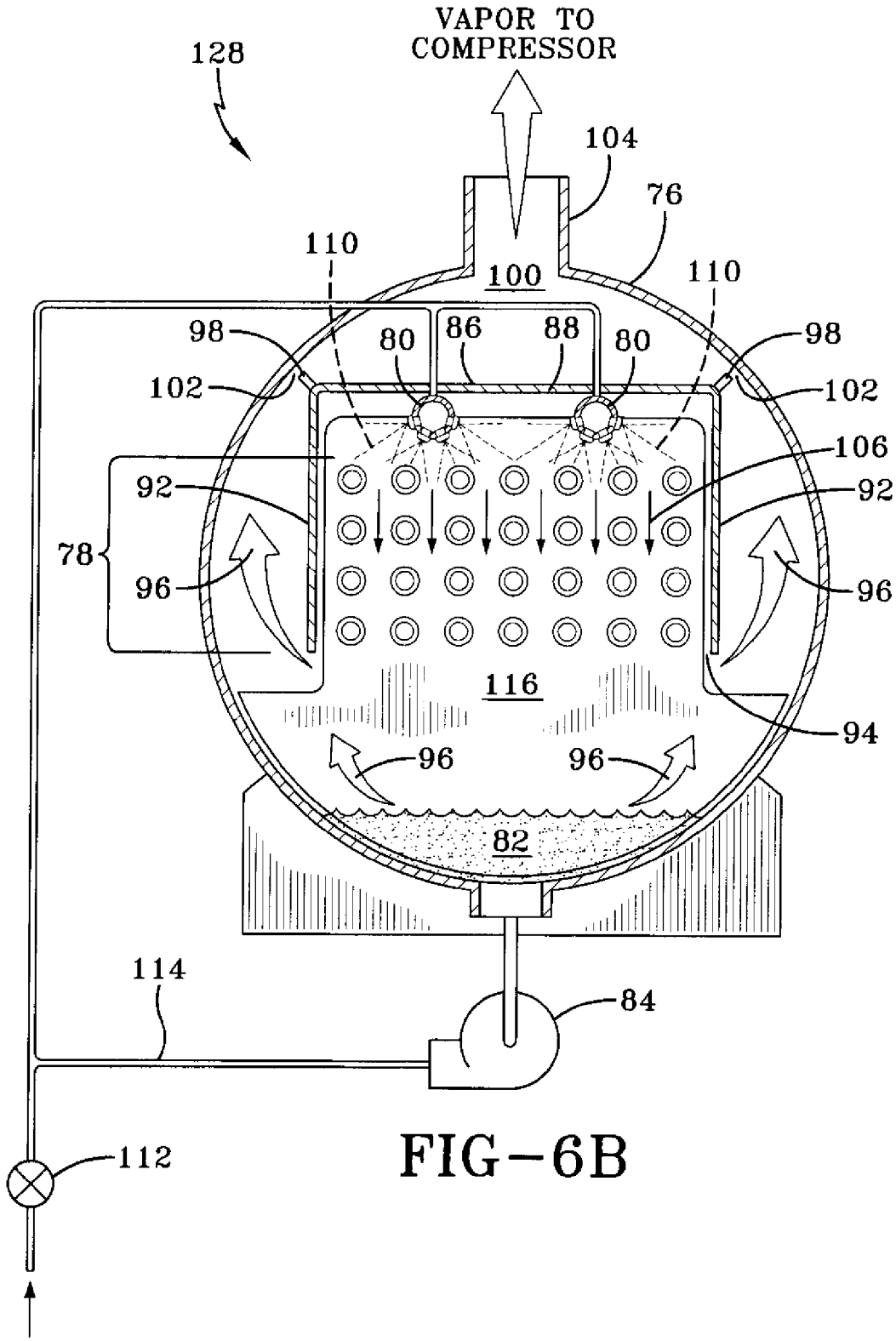
FIGS. 6B and 6C show cross sections of the evaporator exemplary embodiments, with refrigerant, taken along line 6-6 of FIG. 6A.
Figure 6C:
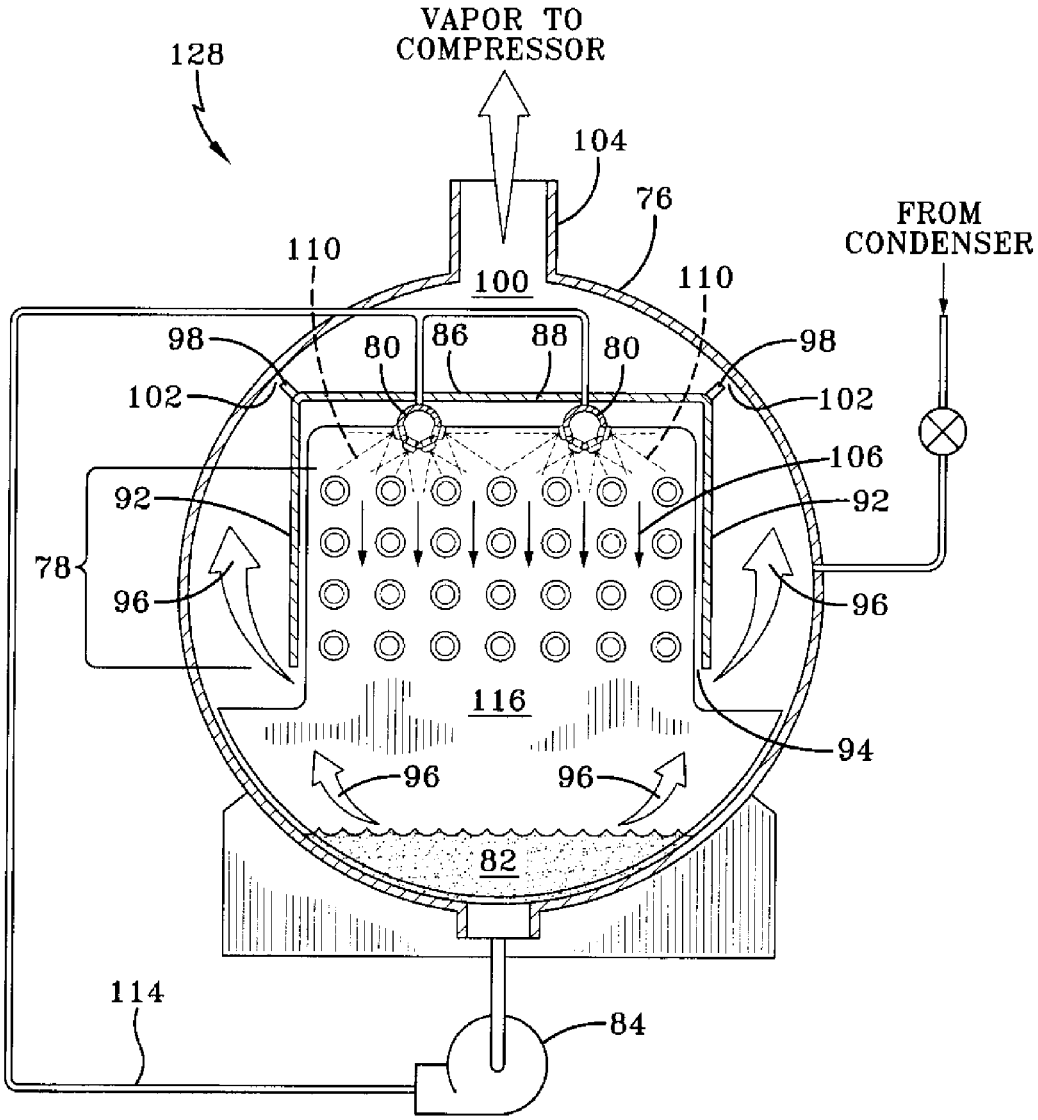

FIGS. 6A through 6C show an exemplary embodiment of an evaporator configured as a "falling film" evaporator 128. As shown in FIGS. 6A through 6C, evaporator 128 is similar to evaporator 138 shown in FIGS. 5A through 5C, except that evaporator 128 does not include tube bundle 140 in the pool of refrigerant 82 that collects in the lower portion of the shell. In an exemplary embodiment, hood 86 terminates after covering tube bundle 78, although in another exemplary embodiment, hood 86 further extends toward pool of refrigerant 82 after covering tube bundle 78. In yet a further exemplary embodiment, hood 86 terminates so that the hood does not totally cover the tube bundle, that is, substantially covers the tube bundle.

As shown in FIGS. 6B and 6C, a pump 84 can be used to recirculate the pool of liquid refrigerant 82 from the lower portion of the shell 76 via line 114 to distributor 80. As further shown in FIG. 6B, line 114 can include a regulating device 112 that can be in fluid communication with a condenser (not shown). In another exemplary embodiment, an ejector (not shown) can be employed to draw liquid refrigerant 82 from the lower portion of shell 76 using the pressurized refrigerant from condenser 34, which operates by virtue of the Bernoulli effect. The ejector combines the functions of a regulating device 112 and a pump 84.

In an exemplary embodiment, one arrangement of tubes or tube bundles may be defined by a plurality of uniformly spaced tubes that are aligned vertically and horizontally, forming an outline that can be substantially rectangular. However, a stacking arrangement of tube bundles can be used where the tubes are neither vertically or horizontally aligned, as well as arrangements that are not uniformly spaced.

In another exemplary embodiment, different tube bundle constructions are contemplated. For example, finned tubes (not shown) can be used in a tube bundle, such as along the uppermost horizontal row or uppermost portion of the tube bundle. Besides the possibility of using finned tubes, tubes developed for more efficient operation for pool boiling applications, such as in "flooded" evaporators, may also be employed. Additionally, or in combination with the finned tubes, porous coatings can also be applied to the outer surface of the tubes of the tube bundles.

In a further exemplary embodiment, the cross-sectional profile of the evaporator shell may be non-circular.

In an exemplary embodiment, a portion of the hood may partially extend into the shell outlet.

In addition, it is possible to incorporate the expansion functionality of the expansion devices of system 14 into distributor 80. In one exemplary embodiment, two expansion devices may be employed. One expansion device is exhibited in the spraying nozzles of distributor 80. The other expansion device, for example, expansion device 36, can provide a preliminary partial expansion of refrigerant, before that provided by the spraying nozzles positioned inside the evaporator. In an exemplary embodiment, the other expansion device, that is, the non-spraying nozzle expansion device, can be controlled by the level of liquid refrigerant 82 in the evaporator to account for variations in operating conditions, such as evaporating and condensing pressures, as well as partial cooling loads. In an alternative exemplary embodiment, expansion device can be controlled by the level of liquid refrigerant in the condenser, or in a further exemplary embodiment, a "flash economizer" vessel. In one exemplary embodiment, the majority of the expansion can occur in the nozzles, providing a greater pressure difference, while simultaneously permitting the nozzles to be of reduced size, therefore reducing the size and cost of the nozzles.

Figure 7A:
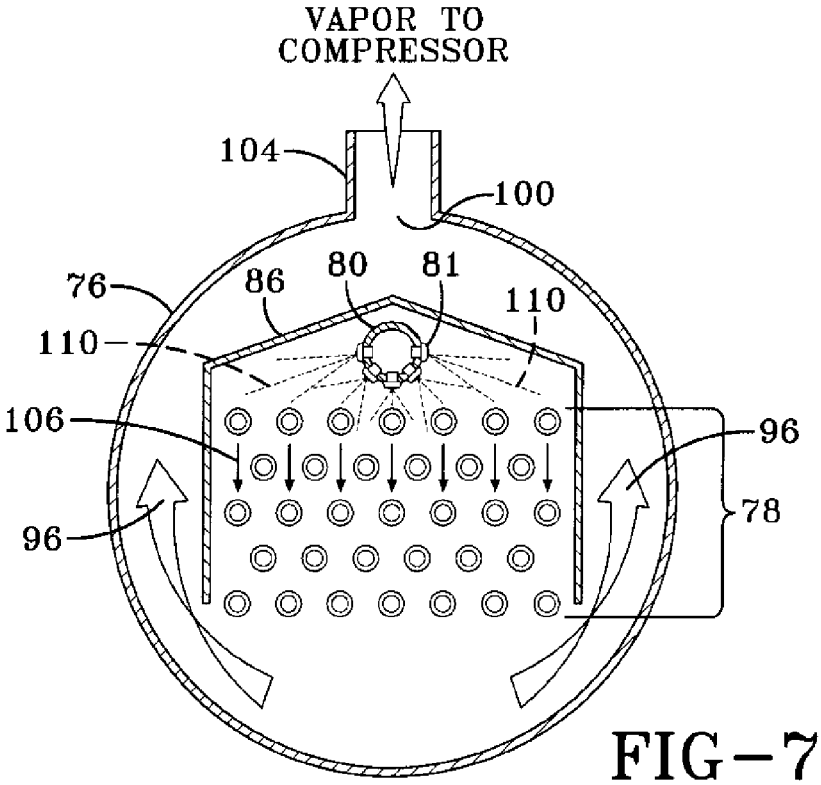
FIGS. 7A through 7C and 8A show cross sections of exemplary embodiments of an evaporator.
Figure 7B:
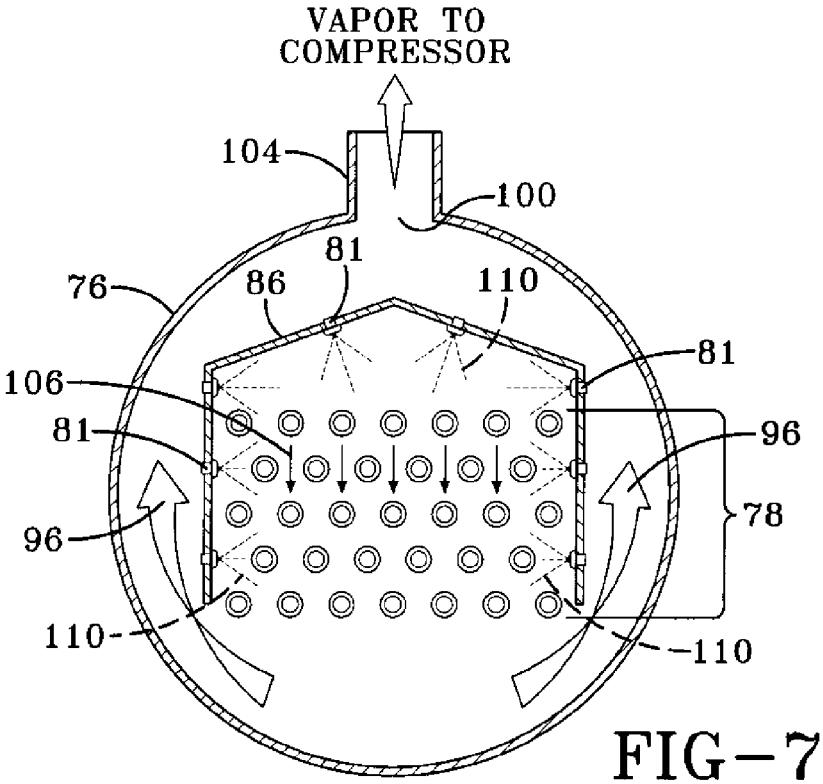
Figure 7C:
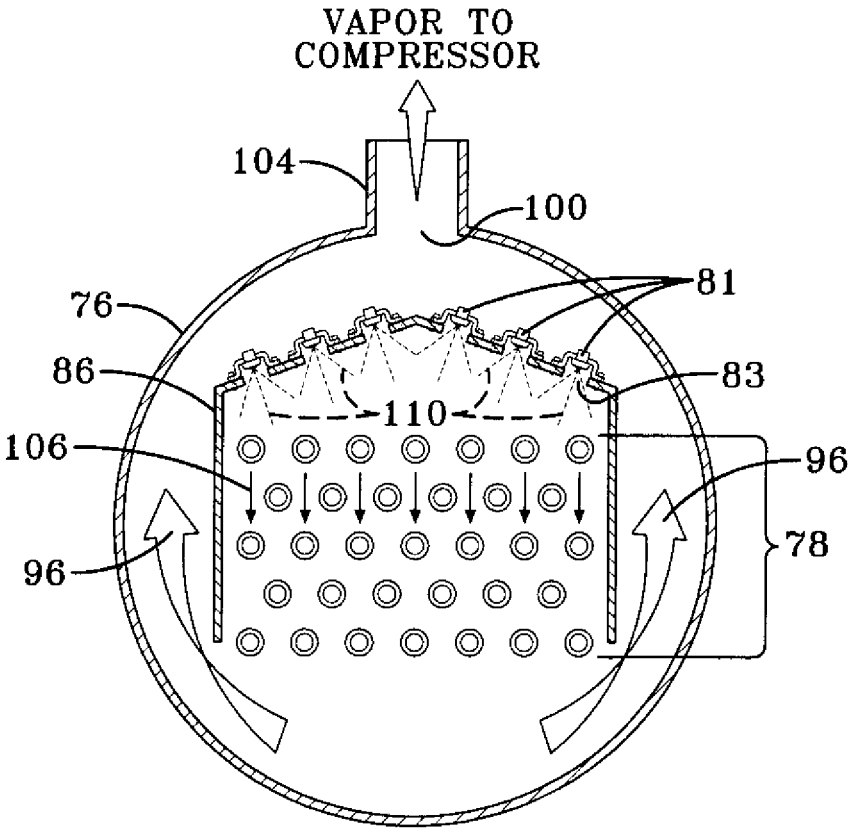

FIGS. 7A through 7C show exemplary embodiments of an evaporator. More specifically, in FIG. 7A, distributor 80 includes a plurality of nozzles 81 separated at predetermined angular intervals, for example, between about 15 degrees to about 60 degrees to apply or distribute applied refrigerant 110 onto the surfaces of tube bundle 78. As further shown in FIG. 7A, both distributor 80 and nozzles 81 are positioned between hood 86 and the tubes of tube bundle 78. In a further exemplary embodiment, the angular intervals are not identical, that is, the nozzles may be positioned in a non-uniform arrangement or pattern, and in another embodiment, the size and/or flow capacity of the nozzles may be different from each other. As shown in FIG. 7B, nozzles 81 are "built into" the structure of hood 86, so that nozzle 81 is not positioned between hood 86 and the tubes of tube bundle 78. In yet a further exemplary embodiment, such as shown in FIG. 7C, distributor nozzles 81 may be positioned near, but exterior of, hood 86, so that distributor 80 is not positioned between hood 86 and tube bundle 78. Although nozzles 81 may not be positioned between hood 86 and tube bundle 78, the nozzles of distributor 80 may be configured to direct/distribute or apply refrigerant onto the surface of at least one tube of the tube bundle, such as through an opening 83 formed in the hood.

Figure 8A:
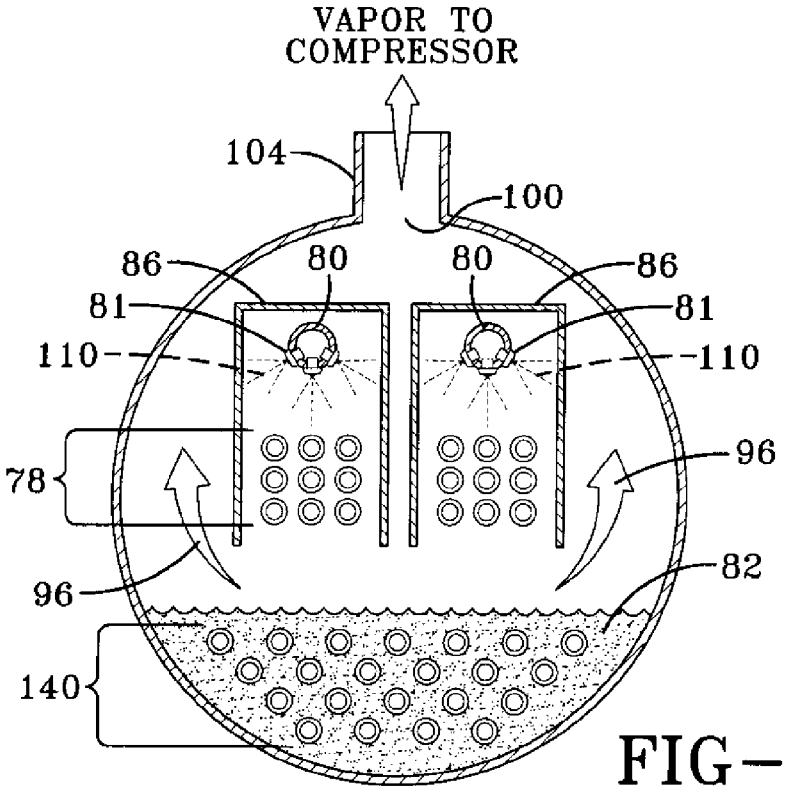
Figure 8B:
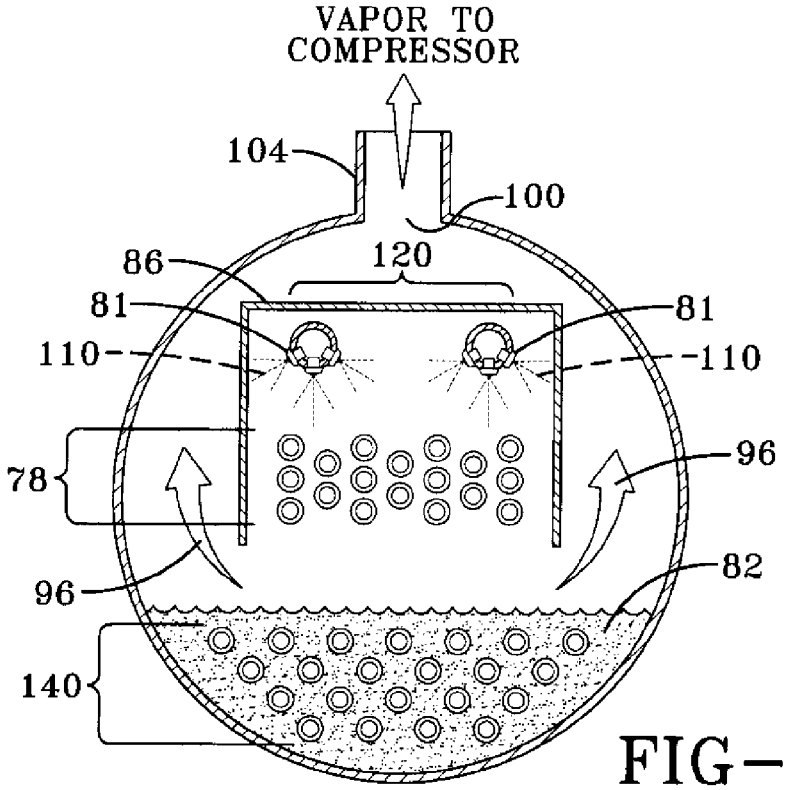
FIG. 8B shows a cross section of an exemplary embodiment of an evaporator, including a partial cross section of the exemplary distributor taken along line 8-8 of FIG. 8C.

FIGS. 8A and 8B show exemplary embodiments of an evaporator. As shown in FIG. 8A, a pair of hoods 86 are positioned within shell 76, with each hood including and covering a respective distributor 80 and tube bundle 78. In an alternate exemplary embodiment, a different number of hoods may be positioned in the shell, with each hood including a corresponding distributor and tube bundle and in a further exemplary embodiment, the respective hoods (and corresponding tube bundle and distributor) may be configured to provide different amounts of refrigerant flow and process fluid flow, that is, configured to provide different heat transfer capacities. As shown in FIG. 8B, hood 86 covers a distributor network or plurality of distributors 120.

Figure 8C:
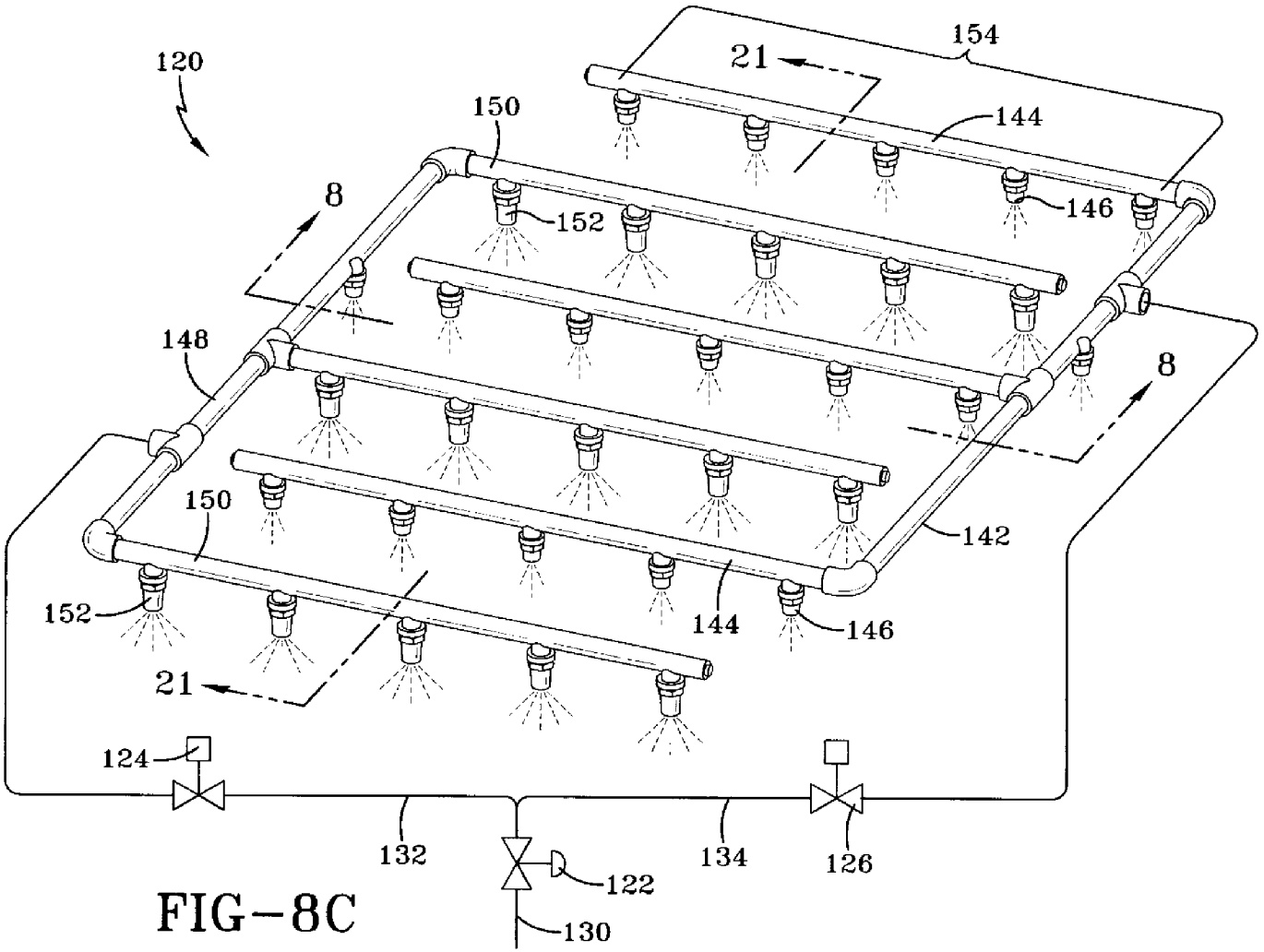
FIG. 8C shows a top perspective view of an exemplary arrangement of a distributor for an evaporator.

FIG. 8C shows an exemplary embodiment of a distributor network or a plurality of distributors 120. An inlet line 130 bifurcates into line 132 and line 134. Upstream of the bifurcation, inlet line 130 includes a metering device 122, such as an expansion valve. Lines 132 and 134 include respective control devices 124 and 126 such as valves, including solenoid valves, to regulate pressure of refrigerant flowing through each of lines 132 and 134. Line 134 is connected to a manifold 142 that branches or divides into different flow paths or flow portions 144. Flow portions 144 include a plurality of nozzles 146. In one exemplary embodiment, manifold 142 includes at least one nozzle 146. Similarly, line 132 is connected to a manifold 148 that branches or divides into different flow portions 150. Flow portions 150 include a plurality of nozzles 152. In one exemplary embodiment, manifold 148 includes at least one nozzle 152. It is to be understood that any combination of manifolds, flow paths from the manifolds and/or nozzles, singly or collectively, may be considered a distributor. In an exemplary embodiment, control devices 124 and 126 may be configured so that the operating pressures between manifolds 142 and 148 and their respective flow paths or flow portions may be different. In other words, plurality of distributors 120 may be configured to distribute fluid at a pressure different than a pressure of another fluid distributed by another distributor of the plurality of distributors.

In a further exemplary embodiment, the number of flow paths or flow portions associated with the manifolds may be different from each other, and that in a yet further exemplary embodiment, a single manifold or more than two manifolds may be used in combination with one or more control devices or metering devices. In another exemplary embodiment, at least one of flow paths or flow portions 144 and 150 include an area of overlap 154. Area of overlap 154 may include multiple orientations between corresponding flow portions 144 and 150, such as horizontal or vertical juxtaposition or other combinations of juxtaposition, as flow paths or flow portions 144 and 150 may be positioned at different vertical, horizontal or angular orientations or rotationally skewed with respect to each other. In other words, at least portions of flow paths or flow portions 144 and 150 may not be parallel to each other. In a further exemplary embodiment, nozzles for at least one flow path or flow portion may be configured to operate at different pressures and or flow capacities.

Figure 9A:
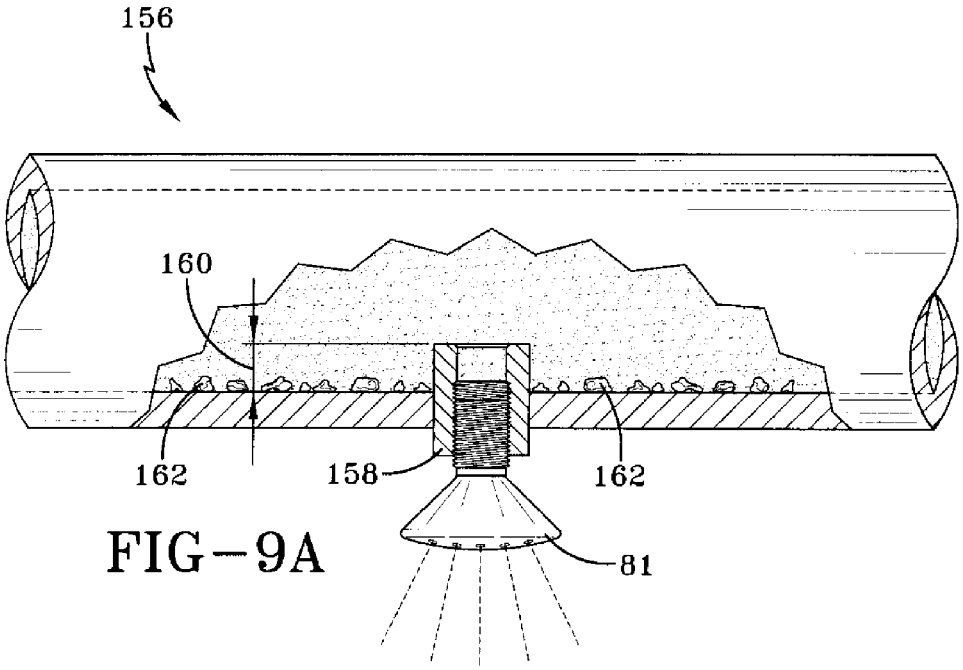
FIG. 9A shows a partial cross section of an exemplary distributor.
Figure 9B:
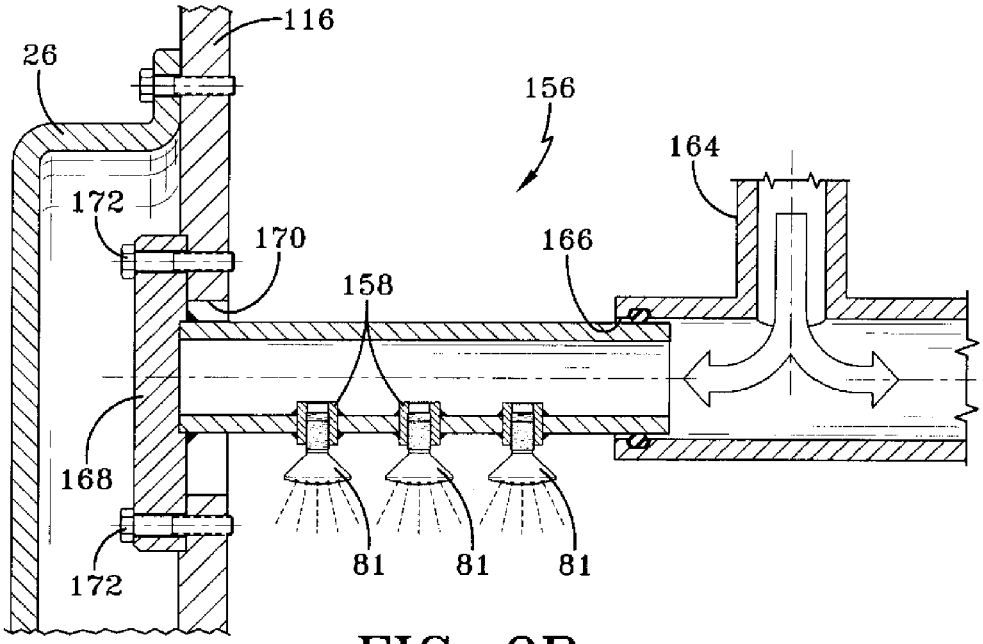
FIG. 9B shows a cross section of an exemplary distributor.

FIGS. 9A and 9B show an exemplary embodiment of a distributor 156. Distributor 156 may include at least one fitting 158 configured to receive a nozzle, such as nozzle 81, shown having a threaded mutual engagement to permit the nozzle to be selectively installed and/or removed, such as for cleaning/replacement. As further shown FIG. 9A, fitting 158 is configured to be installed in distributor 156 such that an end of fitting 158 maintains an insertion distance 160 as measured from the inside surface of the wall of the flow path or flow portion of distributor 156. Insertion distance 160 is configured to reduce flow obstruction, such as by foreign particles or debris 162, and nozzle 81.

FIG. 9B shows an exemplary embodiment in which distributor 156 is configured to be removable from an evaporator without requiring the removal of tube support 116. That is, as further shown in FIG. 9B, an inlet fitting 164 has an opening 166 that is configured to receive one end of distributor 156. The other end of distributor 156 may be inserted through an opening 170 formed in tube support 116, which support commonly being referred to as a sheet, and secured by an end fitting 168 that is secured to tube support 116 by mechanical fasteners 172. Access to distributor 156, such as for servicing/repair, may be achieved upon removal of a process fluid box 26 positioned at one end of the evaporator, and subsequent removal of fasteners 172 of fitting 168. Upon access and extraction of distributor 156 through opening 170, replacement of distributor 156 or any portion of distributor 156, such as nozzles 81 may occur. In one exemplary embodiment, opening 170 is sufficiently sized to remove distributor 156 from the evaporator without the need to remove the nozzles from the distributor.

Figure 10A:
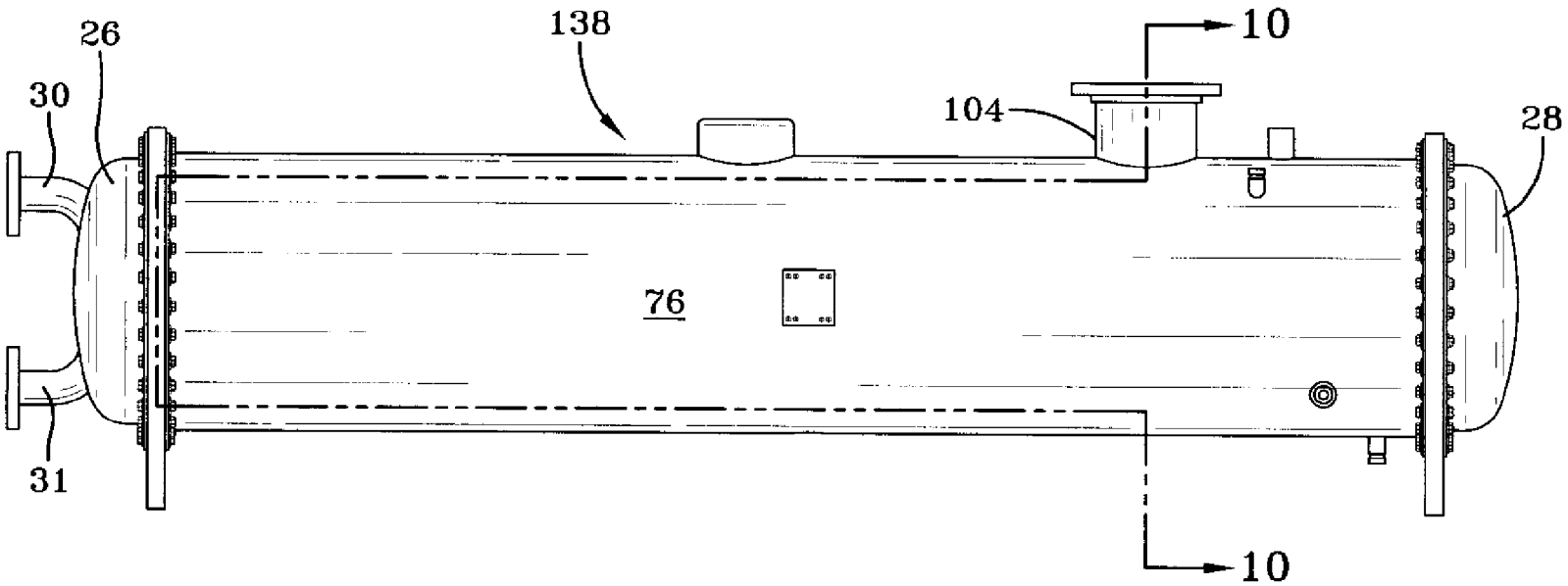
FIG. 10A shows a side elevation view of an exemplary evaporator.
Figure 10B:
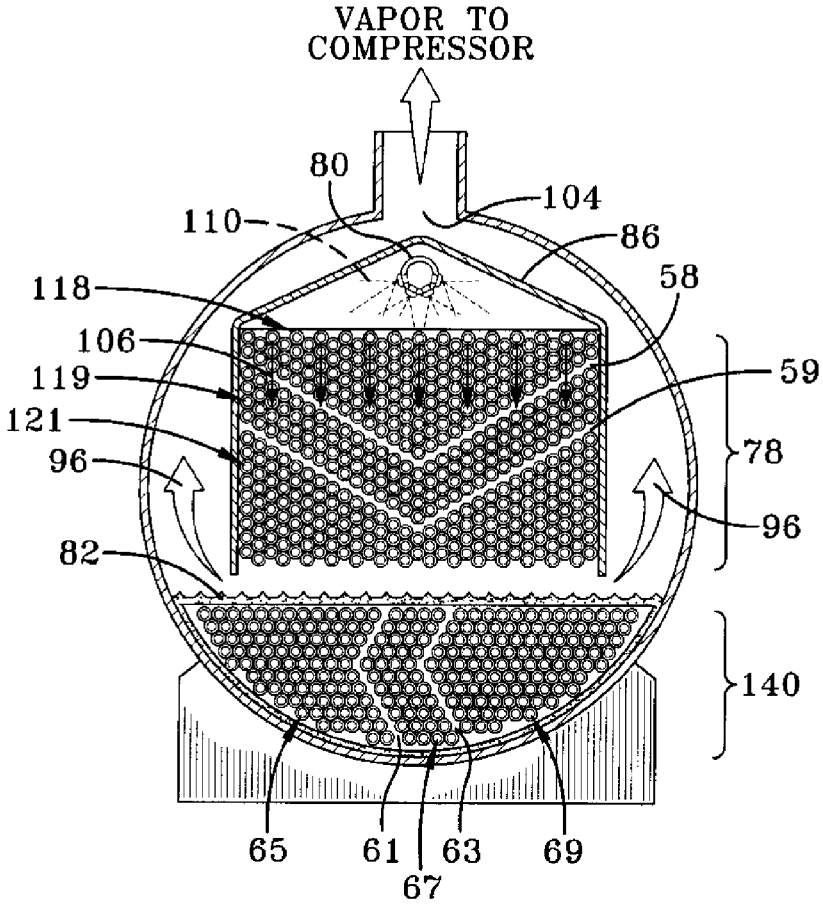
FIG. 10B shows a cross section of the evaporator taken along line 10-10 of FIG. 10A.
Figure 10C:
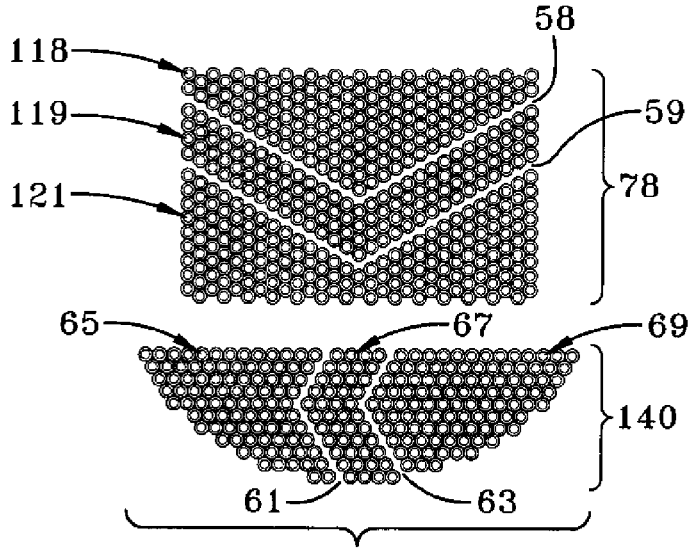
FIG. 10C shows an enlarged partial exploded view of tube bundles of the evaporator of FIG. 10B.

FIGS. 10A through 10C show an exemplary embodiment of evaporator 138. Evaporator 138 includes shell 76 containing refrigerant 82, 96, 106 and 110. Refrigerant 106 and refrigerant 110 are confined to flow around the tubes of tube bundle 78 that is covered by hood 86, and liquid refrigerant which flows around the tubes of tube bundle 78 without changing state forms a pool of liquid refrigerant 82 in the lower portion of shell 76. Evaporator 138 also has headers or process fluid boxes 26 and 28 on each end to enclose shell 76 and serve as a distributor or manifold for the process fluid to enter or exit tubes of tube bundle 78 and tube bundle 140 positioned in the shell. Tubes of tube bundles 78 and 140 of evaporator 138 extend from process fluid box 26 on one end of shell 76 to process fluid box 28 at the opposite end of the shell. Process fluid boxes 26 and 28 separate the process fluid from the refrigerant in shell 76. The process fluid in the tubes of the tube bundles must be separated from the refrigerant contained in the shell so that the process fluid is not mixed with the refrigerant during the heat transfer process between the process fluid in the shell.

FIG. 10A shows evaporator 138 in a two pass configuration, that is, process fluid enters through an inlet 30 and into process fluid box 26 of a first end of evaporator 138, passes through a first set of tubes, that is, one or more tubes of tube bundle 78 and/or tube bundle 140, to process fluid box 28 at the other end of the evaporator, where the process fluid changes direction and then makes a second pass back through shell 76 and a second set of tubes, that is, the remaining tubes of tube bundle 78 and/or tube bundle 140. The process fluid then exits evaporator 138 through outlet 31 on the same end of the evaporator as inlet 30. Other evaporator flow pass configurations (not shown), such as a three pass configuration or a single pass configuration can also be used.

In other embodiments, different partitions or baffles are positioned within process fluid boxes 26 and 28, depending on the flow pass configuration used, such as a two pass configuration or a three pass configuration. FIG. 10B shows an exemplary spacing arrangement that may be used with tube bundle 78 for a two pass or a three pass configuration. As further shown in FIG. 10B (FIG. 10C being an isolated view relating to the partitioning of tube bundles 78 and 140), a spacing or partition 58 separates a tube set 118 from a tube set 119 of tube bundle 78. A spacing or partition 59 separates tube set 119 from a tube set 121 of tube bundle 78. Each of these partitions may or may not be associated with a baffle in one of the process fluid boxes. In other words, partitions 58 and 59 may correspond to baffles that separate entering, uncooled process fluid in process fluid box 26 from the exiting process fluid that has passed twice through the shell. In an exemplary embodiment, partitions 58 and 59 may resemble a herringbone or "V" profile, permitting a compact construction of tube bundle 78, although in other exemplary embodiments, partitions 58 and 59 may contain other profiles, such as a vertically oriented profile. A vertically oriented profile would result in side-to-side flow of the process fluid through the tube sets. A horizontally oriented profile would result in up/down flow of the process fluid through the tube sets. In a further embodiment, tube bundle 140 can be separated into tube sets similar to tube bundle 78 as further shown in FIG. 10C. For example, a spacing or partition 61 separates a tube set 65 from a tube set 67, and a spacing or partition 63 separates tube set 67 from a tube set 69. In another exemplary embodiment, tube bundle 140 may incorporate partitions 61 and 63 that have a horizontally oriented profile.

Figure 11:
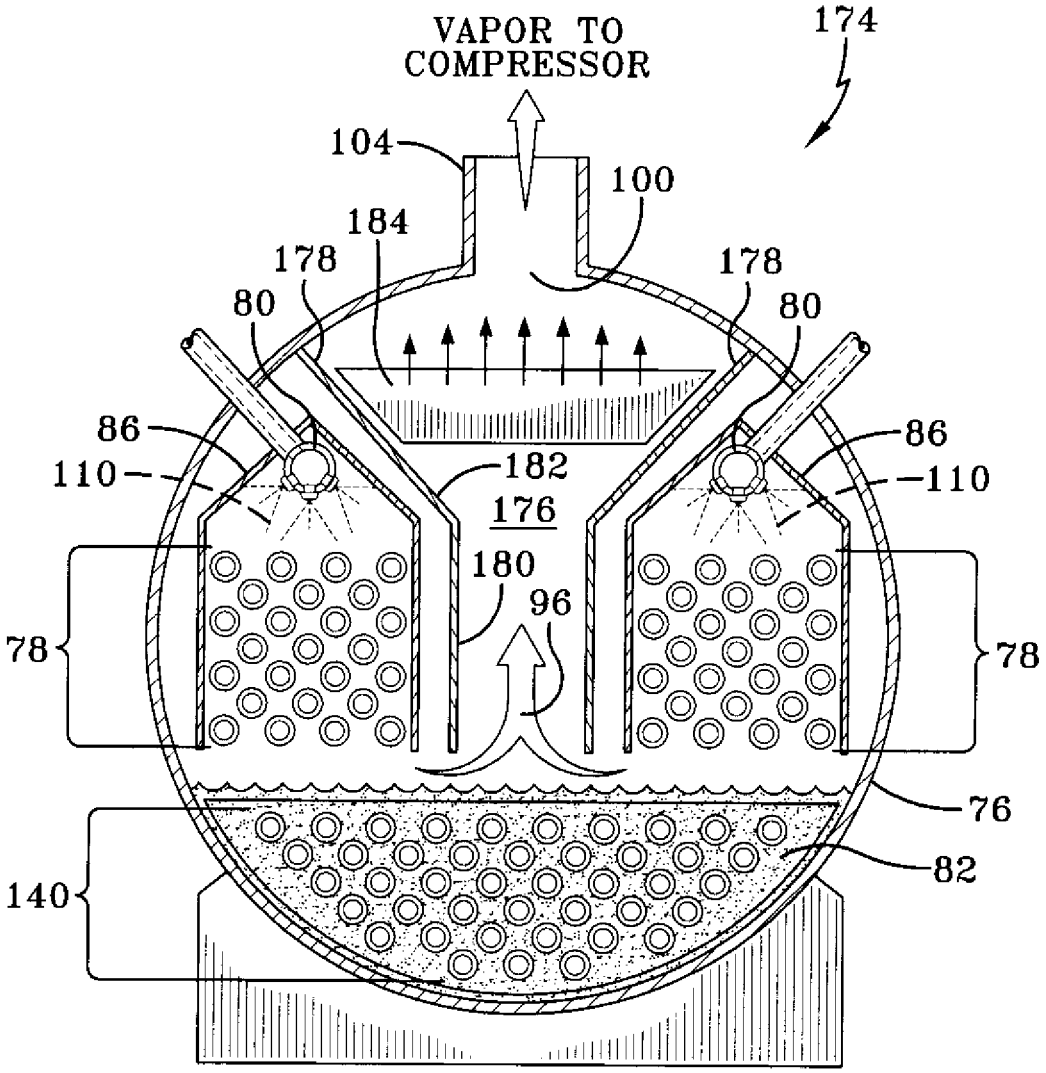
FIGS. 11, 12, 13A through 13D, 14 through 16, 17 and 18 show a cross section of exemplary embodiments of an evaporator of an evaporator.

FIG. 11 shows an exemplary embodiment of an evaporator 174. Evaporator 174 includes a pair of hoods 86, with each hood including a corresponding distributor 80 and tube bundle 78. Because an alternate exemplary embodiment of the evaporator may involve more than two hoods, the hoods will be described as adjacent or proximate hoods, although only a pair of hoods are shown in FIG. 11. Shell 76 includes a partition 178 that includes a first segment 180 connected to one end of a second segment 182, with the other end of second segment 182 extending toward and connecting with shell 76. First segment 180 may extend substantially parallel to corresponding portions of hood 86 covering tube bundle 78. Second segment 182, which may extend toward and connect with shell 76, may be non-parallel to the corresponding portions of hood 86 covering the tube bundle 78. As further shown in FIG. 11, a second partition 178 is provided. First segment 180 of second partition 178 can be parallel with first segment 180 of first partition 178, and second segment 182 second partition 178 can be non-parallel with second segment 182 of first partition 178. A gap 176 separates partitions 178. The portion of gap 176 separating corresponding second segments 182 and extending toward the shell is shown in FIG. 11 as diverging from the portion of gap 176 separating corresponding first segments 180, although in an alternate embodiment, the gap portion separating second segments 182 may converge. Gap 176 may be configured to guide refrigerant 96 exiting the adjacent hoods 86 toward outlet 104. A filter 184, commonly referred to as a "mist eliminator" or "vapor/liquid separator", may be positioned in the portion of gap 176 near or between corresponding second segments 182. In one exemplary embodiment, filter 184 may be positioned near outlet 104. In another exemplary embodiment, partitions 178 may be symmetrically positioned between adjacent tube bundles that are covered by corresponding adjacent hoods. In a yet a further exemplary embodiment, at least portions of partitions 178 may be substantially coincident with a corresponding portion of hood 86 and in another embodiment, hoods 86 may replace portions, if not one or both in their entirely, of partitions 178.

Figure 12:
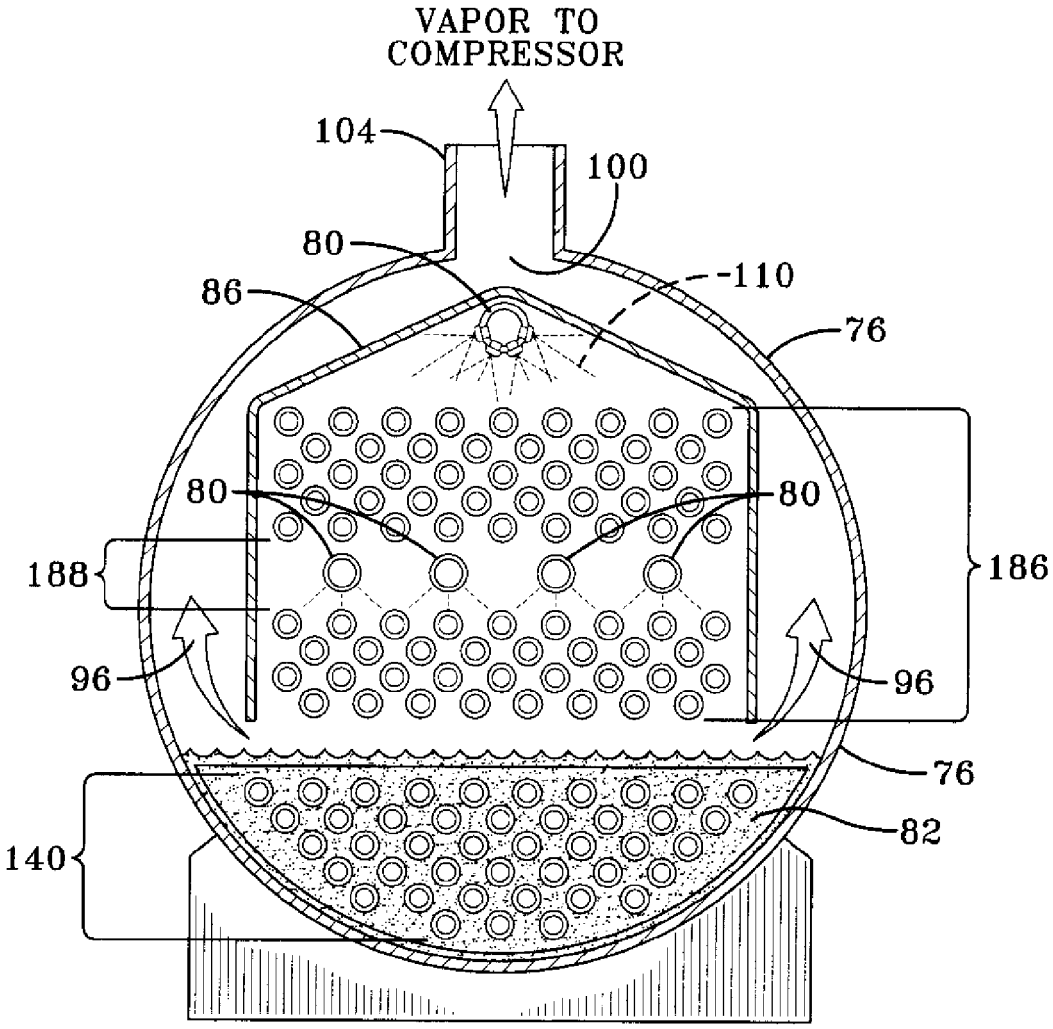

FIG. 12 shows an exemplary embodiment of an evaporator with a tube bundle 186 covered by hood 86 in which, in addition to distributor 80 positioned between hood 86 and the upper tubes of tube bundle 186, at least one additional distributor 80 is provided in a gap 188 positioned in an intermediate area of tube bundle 186. The additional distributors may be positioned between the tubes of the tube bundle, providing a multiple/multi-level application of applied refrigerant onto the surfaces of the tube bundles, thereby improving performance/capacity of the evaporator by providing an enhanced wetting of the tubes of the tube bundles. And a further exemplary embodiment, tubes of the tube bundle can at least partially surround the distributor(s). In an alternate exemplary embodiment, the additional distributors may be positioned differently, that is, in columns or other non-uniform arrangement.

Figure 13B:
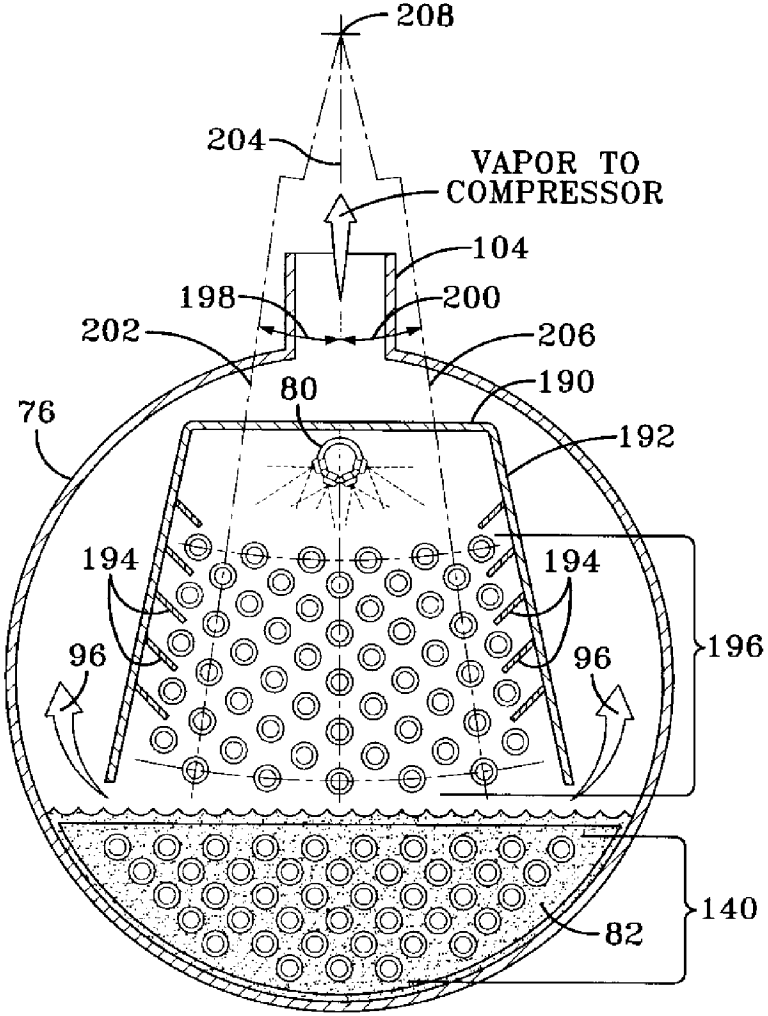
Figure 13A:
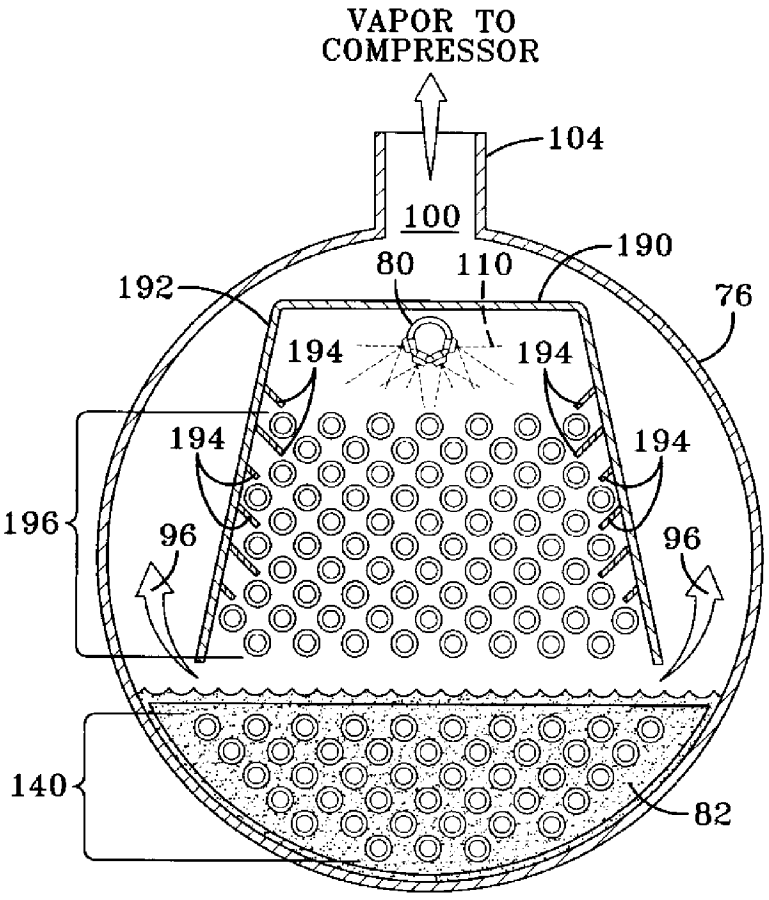
Figure 13D:
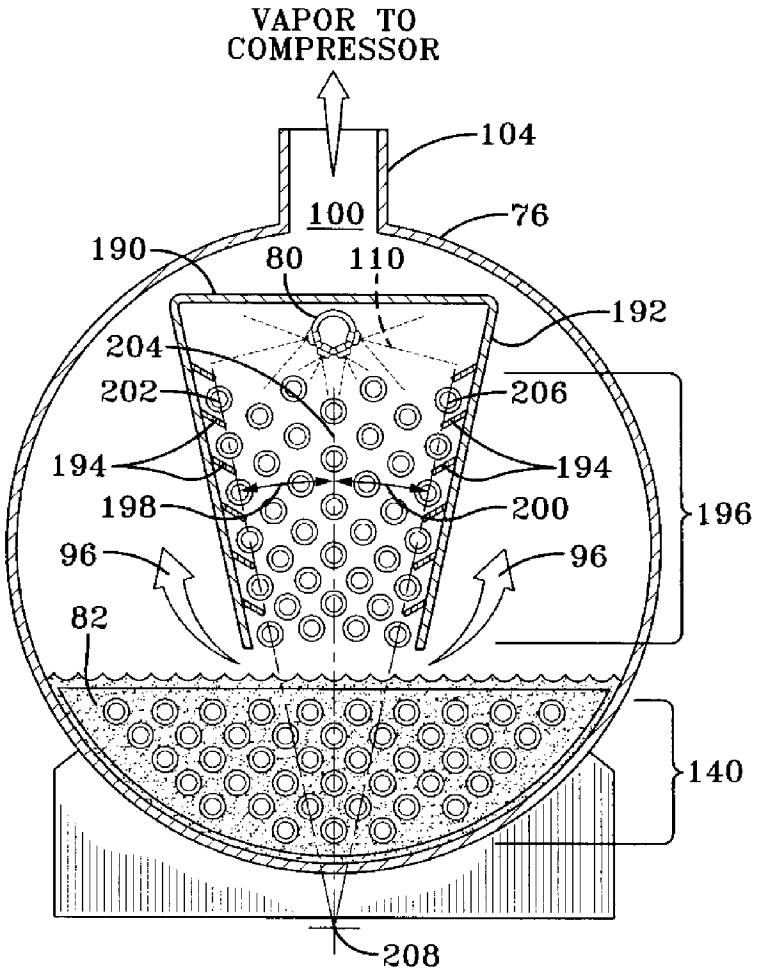
Figure 13C:
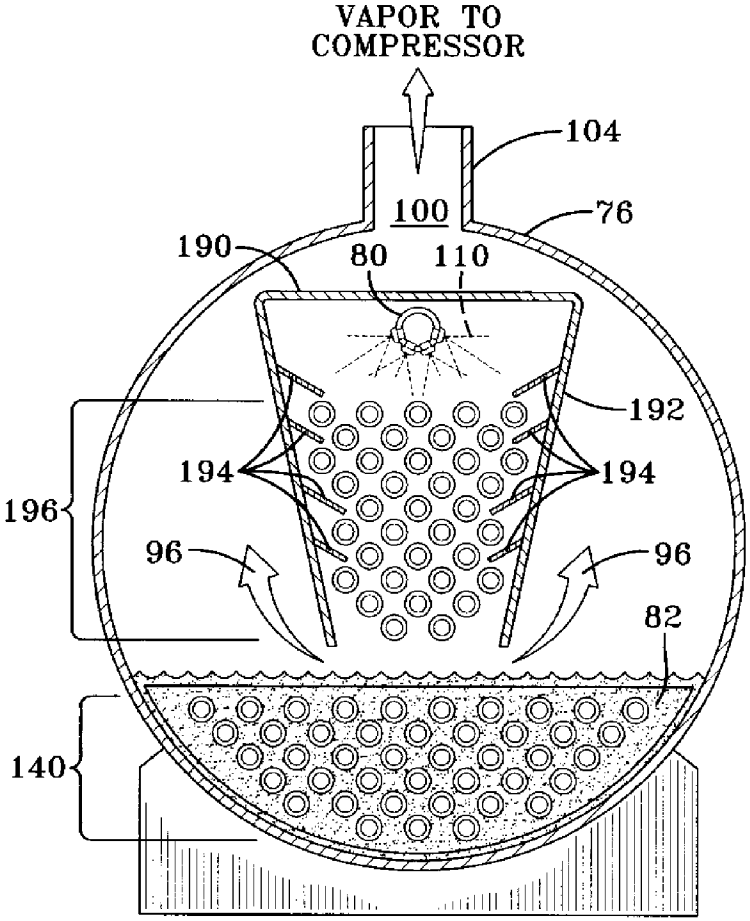

FIGS. 13A through 13D show exemplary embodiments of hood 190 covering a tube bundle 196. Opposed walls 192 of hood 190 may not be parallel to each other. Walls 192 may diverge away from each other in a direction toward the open end of the hood as shown in FIGS. 13A and 13B, and converge toward each other in a direction toward the open end of the hood as shown in FIGS. 13C and 13D. Protrusions 194, which extend inwardly from one or both walls 192 toward the opposed wall 192, is configured to drain and deposit or apply a fluid, that is, liquid droplets that have coalesced or agglomerated on the wall and/or protrusion, onto tubes of tube bundle 196. As shown in FIG. 13B, the tubes of tube bundle 196 may be arranged in columns that are disposed at different angles to each other. For example, a centrally positioned column having an axis 204 is positioned at an angle 198 with respect to a column of tubes having an axis 202. Similarly, the tube column having axis 204 is positioned at an angle 200 with respect to a column of tubes having an axis 206. To provide a point of reference for measuring angles 198 and 200, axes 202, 204 and 206 extend from a common focal point 208. In summary, axes 202 and 204 are not parallel, nor are axes 204 and 206. By incorporating non-parallel tube column axes, especially with divergent hood walls, it may be possible to insert an additional column(s) of tubes under the hood, or to at least a partial column of tubes into the tube bundle. Alternately, by incorporating non-parallel tube column axes with convergent hood walls, resulting in a reduced spacing between tube columns, may enhance the amount of heat transfer occurring at the bottom of the tube bundle near the narrowed open end of the hood.

Figure 14:
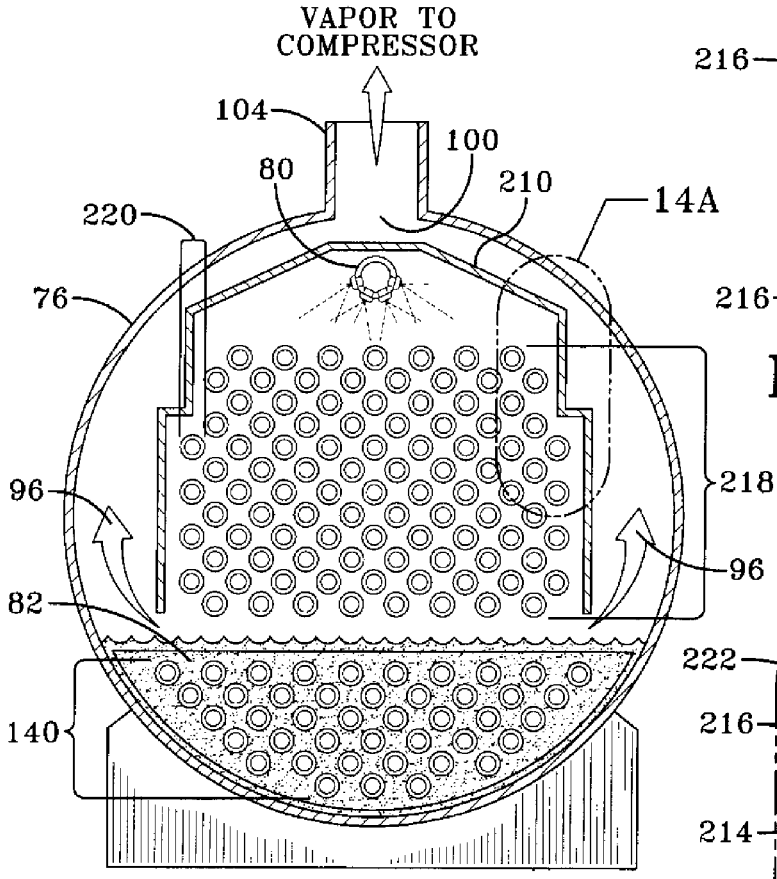
Figure 14A:
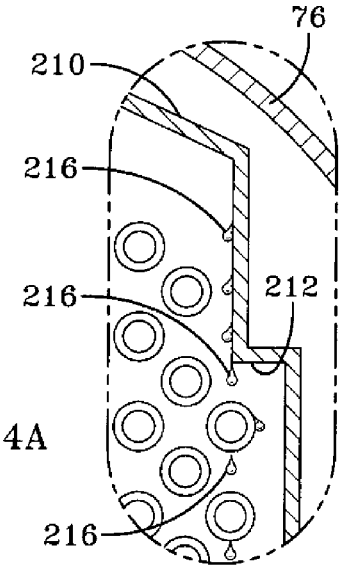
FIGS. 14A and 14B are enlarged partial views of exemplary distributor embodiments of the evaporator taken along region 14A of FIG. 14.
Figure 14B:
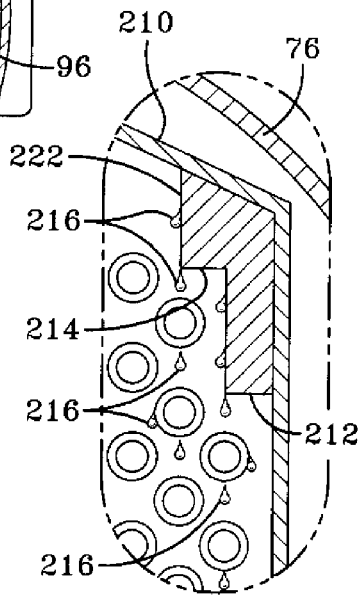

FIGS. 14, 14A and 14B show exemplary embodiments of an evaporator with a hood 210. Hood 210 may include a discontinuity 212 formed along a surface of the hood. Discontinuity 212 may include indented or protruding portions or other surface features formed in the hood surface. Discontinuity 212 is configured to deposit or apply a fluid, that is, liquid droplets 216 that have coalesced or agglomerated on the wall and/or discontinuity, onto tubes of a tube bundle 218 covered by hood 210. In one exemplary embodiment, the hood, including the discontinuity, may be of unitary construction. In another exemplary embodiment, a member 222 can be secured to hood 210, to provide the discontinuity, or an additional discontinuity in the hood. In yet another exemplary embodiment, member 222 can include multiple discontinuities, such as an additional discontinuity 214. In one exemplary embodiment, an additional column of tubes 220, or at least partial column of tubes may be inserted in the hood by virtue of the addition of the hood discontinuity.

Figure 16:
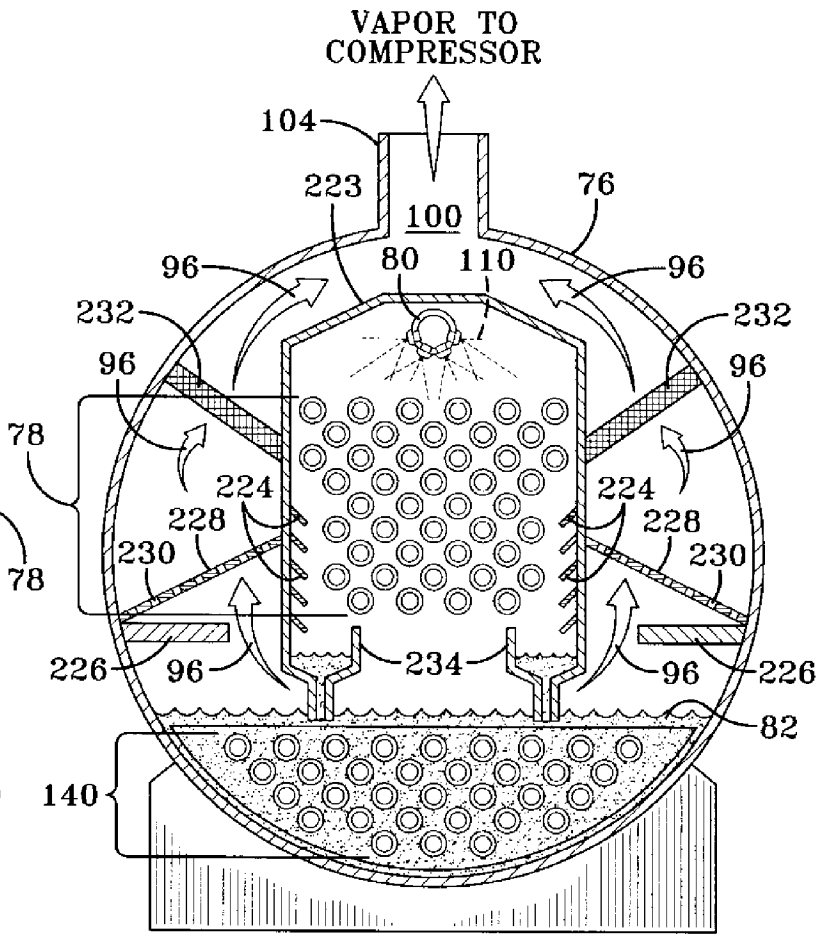
Figure 15:
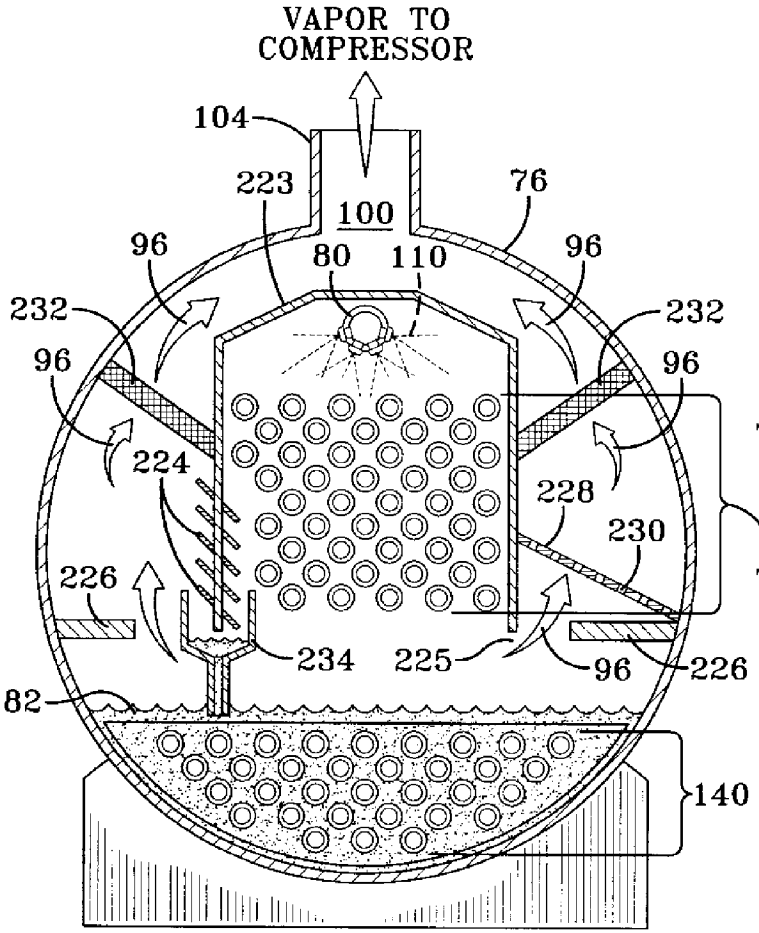

FIGS. 15 and 16 show exemplary evaporator embodiments. A hood 223 which covers a tube bundle 78 may include louvers or finned openings 224 formed in at least one wall of the hood near the open end of the hood. Tube bundle 78 may be separated from tube bundle 140 by a gap 225 that may include a collector 234. Collector 234 may reduce "liquid carryover" by preventing contact of liquid with vapor in a region of relatively high vapor velocity. In one exemplary embodiment, collector 234 may be positioned near finned openings 224 to collect liquid droplets that have coalesced or agglomerated on the hood walls. In another exemplary embodiment, collector 234 may be of unitary construction with the hood. In a further exemplary embodiment, collector 234 may include openings (not shown) between portions of the collector, so that refrigerant 96 can travel around the open end of hood 223 and through gap 225 without encountering pool of refrigerant 82. Refrigerant 96 traveling around the open end of hood 223 must further travel around a first obstruction 226 and through a second obstruction 228 that may be positioned near first obstruction 226, each obstruction being positioned near the open end of the hood. In one exemplary embodiment, first obstruction 226 may extend from shell 76 toward hood 223, although in another exemplary embodiment, first obstruction 226 may extend from hood 223 toward shell 76. In a further exemplary embodiment, second obstruction 228 may include a plurality of openings 230. A filter 232, commonly referred to as a "mist eliminator" or "vapor/liquid separator" may extend between hood 223 and shell 76. In one exemplary embodiment, filter 232 is positioned at an angle other than 90 degrees with the wall of the hood 223.

Figure 17:
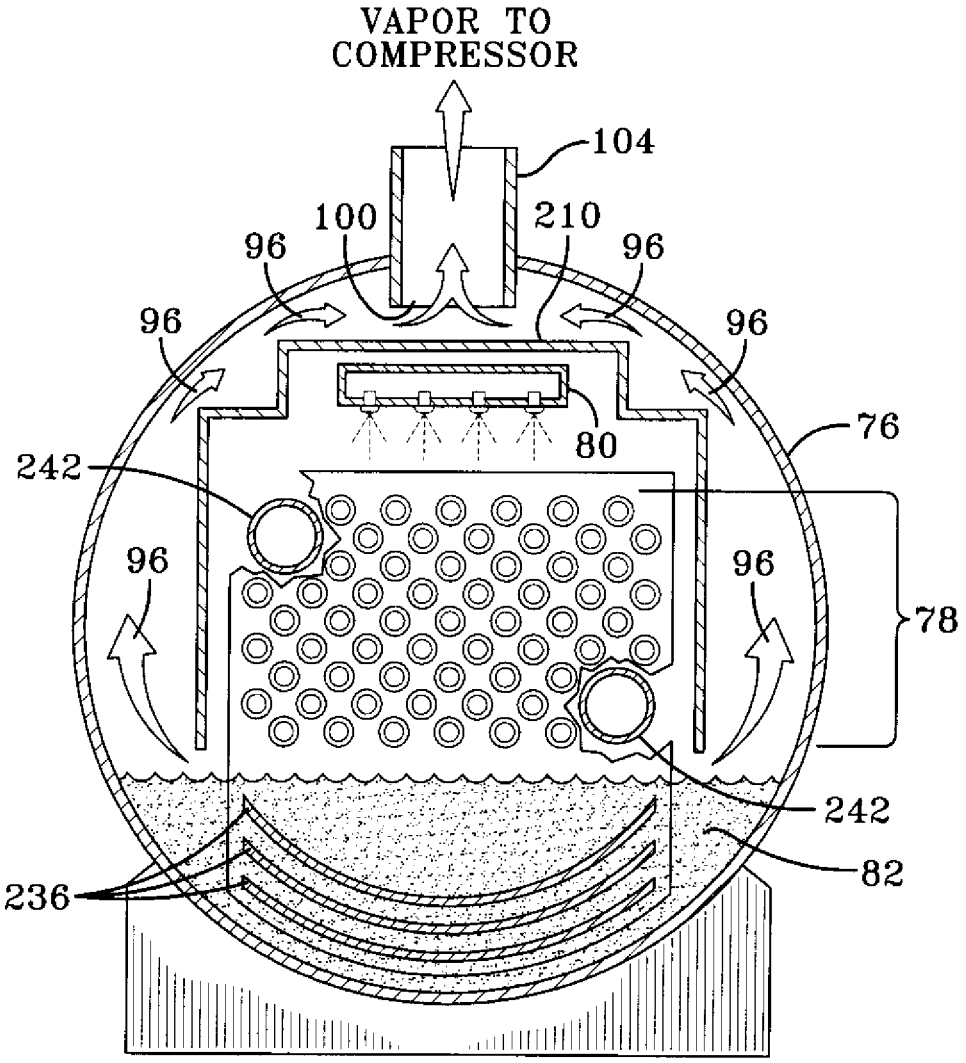
Figure 17A:
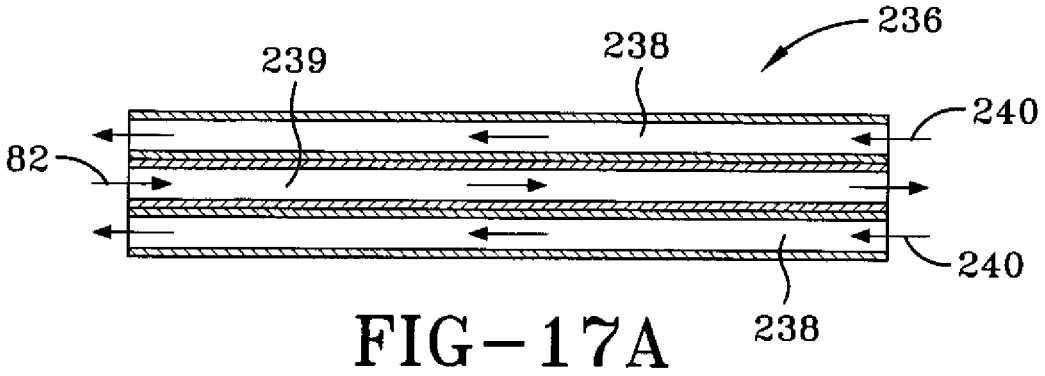
FIGS. 17A and 18A show a cross section of exemplary embodiments of a heat exchanger of an evaporator.
Figure 18:
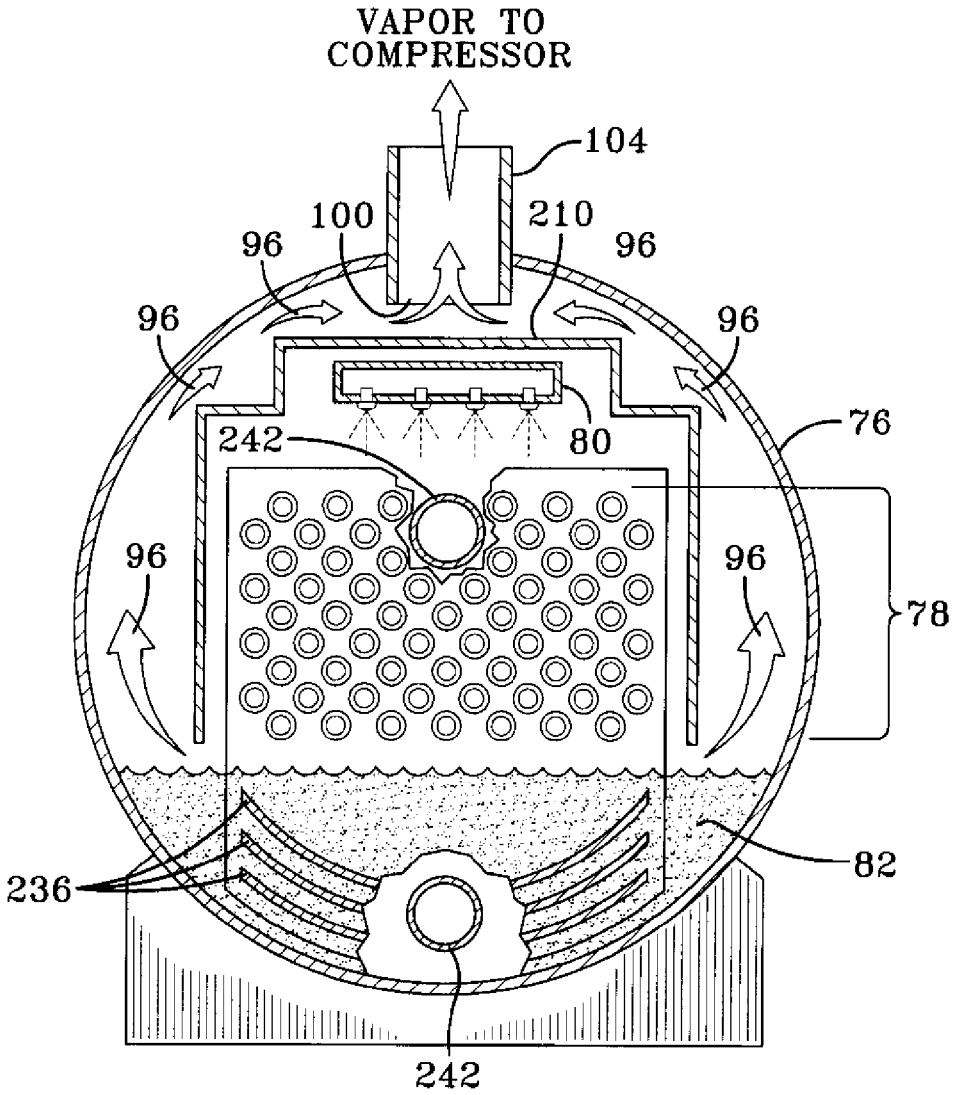
Figure 18A:
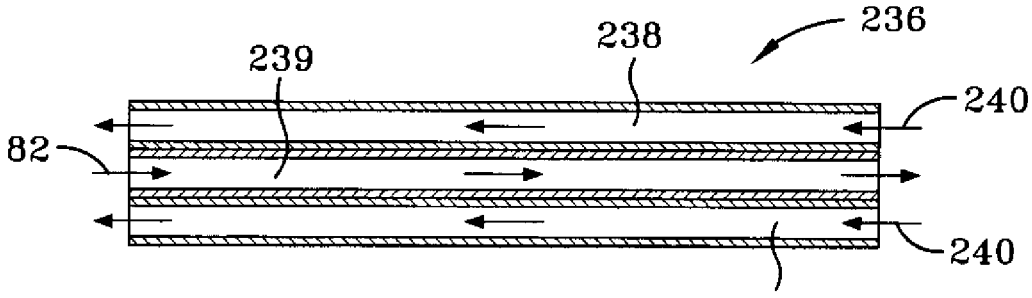
Figure 19B:
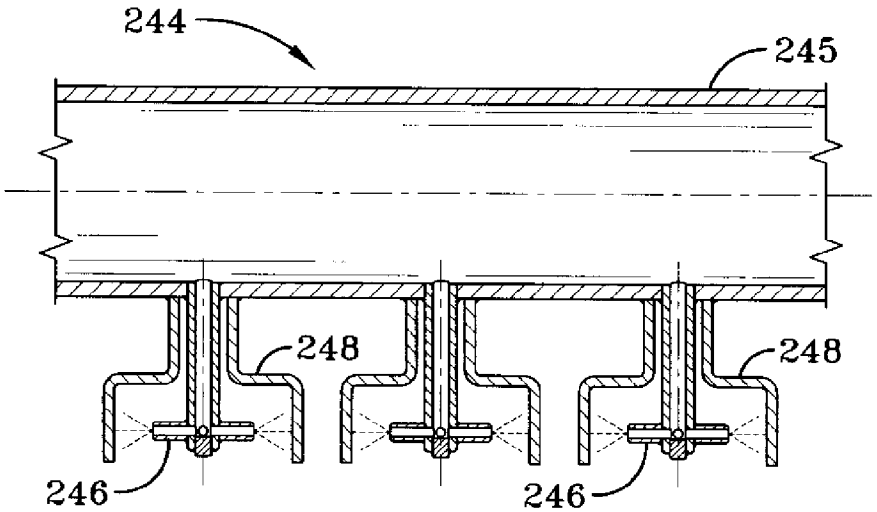
FIGS. 19A and 19B show a cross section of exemplary embodiments of a distributor.
Figure 20:
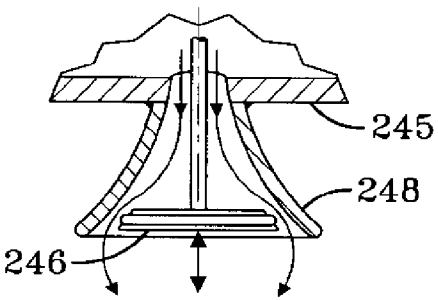
FIG. 20 shows a partial cross section of an exemplary embodiment of a distributor nozzle.
Figure 19A:
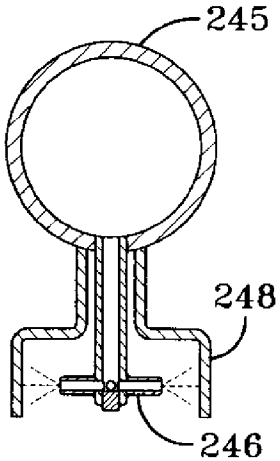
Figure 19C:
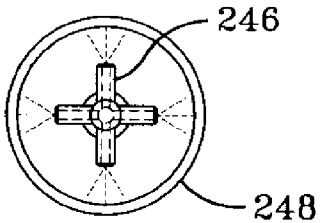
FIG. 19C shows a bottom view of an exemplary embodiment of a distributor nozzle.

FIGS. 17, 17A, 18 and 18A show exemplary embodiments of an evaporator with a heat exchanger 236. Heat exchanger 236 may include spaced passageways 238 through which a process fluid 240 flows in a passageway 239 to effect or implement transfer of thermal energy between refrigerant 82 and process fluid 240. Heat exchanger 236 may be configured for immersion in a fluid such as liquid refrigerant 82. In an exemplary embodiment, heat exchanger 236 may be configured for selective fluid communication with process box inlet/outlet 242 constructions, such as shown in FIGS. 17 and 18 as a two pass or a three pass configuration. In one exemplary embodiment of a two pass construction, the first pass may include the flow of process fluid through the tubes of tube bundle 78 with the second pass including the flow of process fluid through heat exchanger 236. In other exemplary embodiments, other combinations of tubes of tube bundle 78 and/or heat exchanger 236 may be utilized to construct the two or three pass, or more (passes), constructions. In a further exemplary embodiment, at least a portion of the surface of heat exchanger 236 is configured to enhance a transfer of thermal energy along the heat exchanger surface such as by sintering, surface roughing or other surface treatment.

FIGS. 19A through 19C and 20 show exemplary embodiments of a distributor 244. Distributor 244 may include a flow path or flow portion 245 connected to a plurality of nozzles 246. As further shown in FIGS. 19A through 19C and 20, distributor 244 includes a shroud 248 covering nozzle 246. In one exemplary embodiment, shroud 248 may be configured to at least partially confine a fluid spray from nozzle 246, such as confining the nozzle spray to the extent of the cross section associated with the shroud opening, that is, a predetermined cross sectional area. As further shown in FIG. 20, a construction of nozzle 246 may include a plunger-type construction, in which the nozzle/valve member is configured to move with respect to shroud 248 between a first (substantially closed) position and a second (fully opened) position, although other intermediate positions between the first and second position may be utilized. In one exemplary embodiment, the shaft extending from the nozzle/valve member may further extend through the flow portion and controlled by driving device, such as a motor (not shown).

Figure 21:
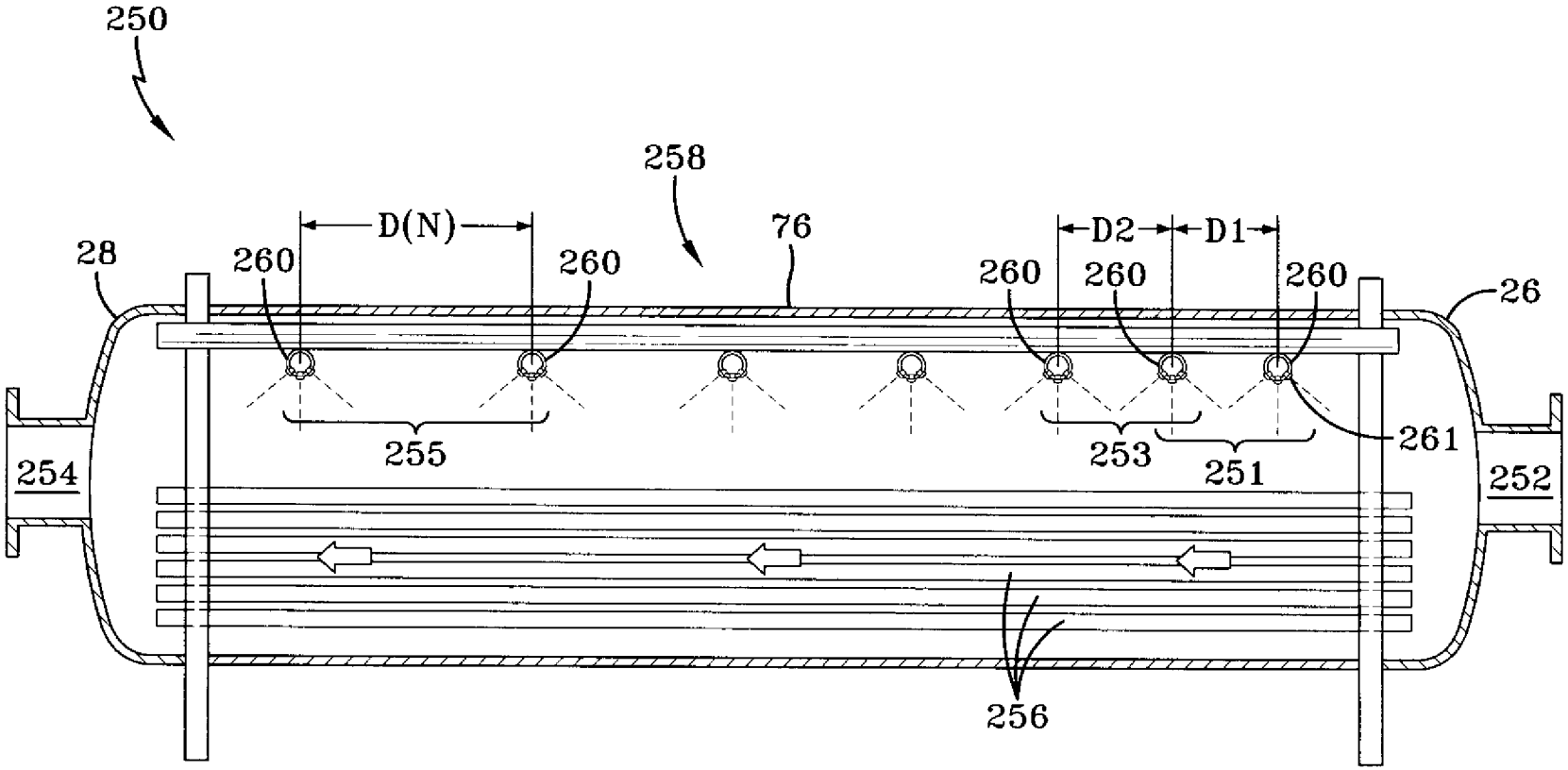
FIG. 21 shows a cross section of an exemplary embodiment of an evaporator and includes an evaporator with distributor similar to distributor of FIG. 8C.

FIG. 21 shows an exemplary distributor embodiment for an evaporator 250. Evaporator 250 may include a distributor network or plurality of distributors 258 having flow paths or flow portions 260, which flow portions 260 may include nozzles 261 configured to apply or direct a fluid onto surfaces of tube bundle 256. Shell 76 may include an inlet 252 associated with process fluid box 26 and an outlet 254 associated with process fluid box 28. In a one pass configuration, as shown in FIG. 21, although multi-pass configurations may be used in alternate exemplary embodiments, opposed ends of the tubes of tube bundle 256 extend between process fluid boxes 26 and 28 so that process fluid entering inlet 252 is directed through tube bundle 256, exiting shell 76 through outlet 254. The cross section of flow portions 260 of plurality of distributors 258 (shown in FIG. 21) may be similar to the cross section of plurality of distributors 120 taken along line 21-21 of FIG. 8C. However, a distinction between the cross section associated with line 21-21 of FIG. 8C (plurality of distributors 120) and plurality of distributors 258 (shown in FIG. 21) is the relative spacing between adjacent flow portions 260. That is, adjacent flow portions 260 nearest to inlet 252, referred to as paired flow portions 251, are separated from each other by a spacing or distance D1. In paired flow portions 253, adjacent flow portions 260 are separated from each other by a spacing or distance D2. Distance D2 is configured to the greater than distance D1.

Similarly, the distance between adjacent flow portions 260 furthest from inlet 252, referred to as paired flow portions 255, is distance D(N), which distance D(N) being greater than the distance between the other adjacent flow portions 260 shown in FIG. 21.

The process fluid, with respect to evaporator 250, is at its highest temperature upon entering inlet 252 of the evaporator, resulting in a maximum difference in temperature between the process fluid and the refrigerant contained in the evaporator, also referred to as "delta T". At a maximum "delta T", a corresponding maximum thermal energy transfer would occur between the refrigerant and the process fluid. Accordingly, by increasing the amount of refrigerant deposited onto the tubes of tube bundle 256 nearest to inlet 252, such as by reducing the spacing between adjacent flow portions 260 positioned nearest to inlet 252, the thermal energy transfer between the process fluid and the refrigerant can be increased. In one exemplary embodiment, the spacing between flow portions 260 may be non-uniform and in a further embodiment, the spacing or distance between adjacent flow portions 260 of the plurality of distributors can be increased or decreased by a predetermined amount such as to maximize thermal energy transfer between the process fluid and the refrigerant. In other exemplary embodiments, the spacing arrangement may differ for reasons including non-uniform flow rates through the flow portions.

Figure 22:
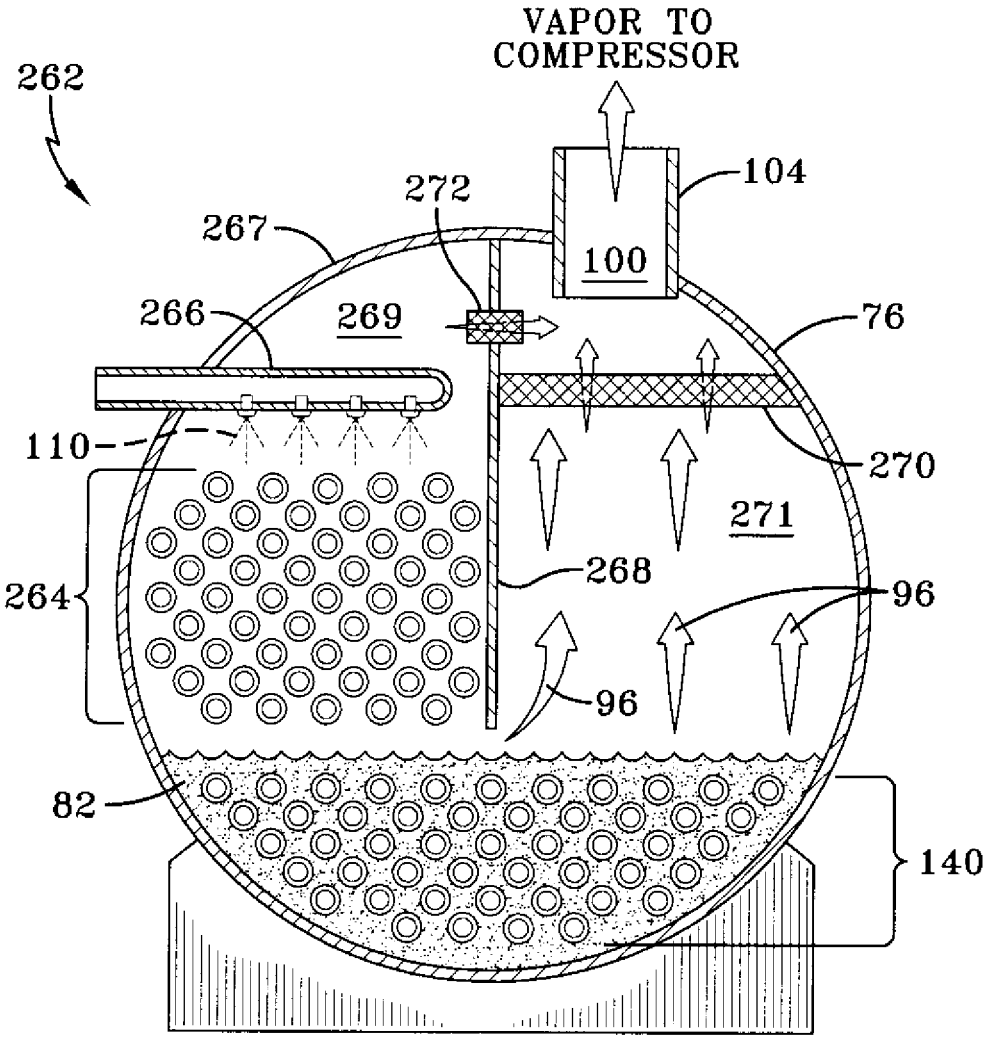
FIG. 22 shows a cross section of an exemplary embodiment of an evaporator.

FIG. 22 shows an exemplary embodiment of an evaporator. Evaporator 262 may include a partition 268. As further shown in FIG. 22, partition 268 and a portion of shell 76 collectively form a hood 267, which hood and partition divide shell 76 into compartments 269 and 271. A distributor 266 deposits applied refrigerant 110 onto the surfaces of tube bundle 264, both of the distributor and tube bundle being covered by hood 267. In one exemplary embodiment, partition 268 may include a filter 272, commonly referred to as a "mist eliminator" or "vapor/liquid separator" positioned near outlet 104 configured to remove entrained liquid from refrigerant flowing through partition 268. Tube bundle 264, which is covered by hood 267, is confined to compartment 269. As further shown in FIG. 22, partition 268 borders tube bundle 264 and terminates near the gap separating tube bundles 264 and 140. In a still further exemplary embodiment, evaporator 262 may not include tube bundle 140 (but a pump or ejector would be needed, such as in FIGS. 6B and 6C). In another exemplary embodiment, partition 268 may further extend past the gap separating tube bundles 264 and 140, and terminate near tube bundle 140. As further shown in FIG. 22, refrigerant 96 flowing around partition 268 enters compartment 271 encounters filter 270, commonly referred to as a "mist eliminator" or "vapor/liquid separator" positioned near outlet 104 that extends between partition 268 and shell 76.

Figure 23:
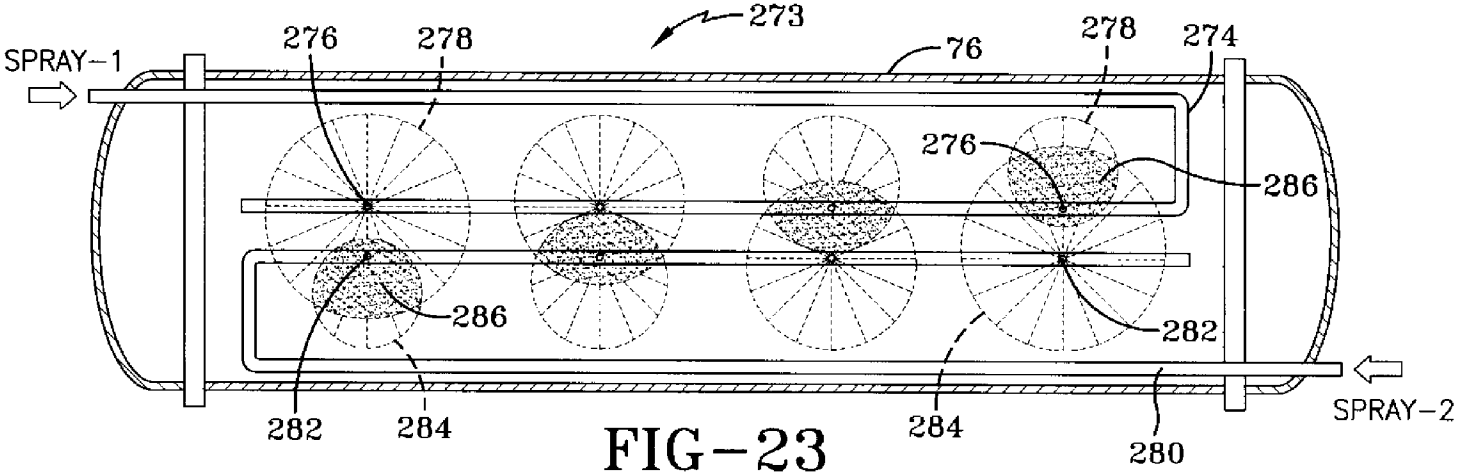
FIGS. 23 and 24 show a cross section and an elevation end view of an exemplary embodiment of an evaporator.
Figure 24:
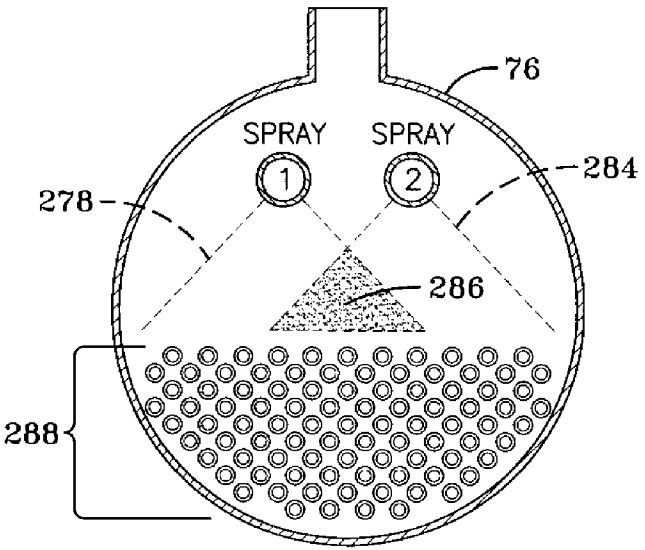

FIGS. 23 and 24 show an exemplary distributor 273. Distributor 273 may include a distributor flow path or flow portion 274, also referred to as "SPRAY-1", and a distributor flow path or flow portion 280, also referred to as "SPRAY-2". Distributor flow portion 274 may include nozzles 276, with each nozzle 276 having a corresponding spray distribution area 278. Distributor flow portion 280 may include nozzles 282, with each nozzle 282 having a corresponding spray distribution area 284 onto surfaces of tubes of tube bundle 288. An overlap 286 represents the overlapping spray between corresponding spray distribution areas 278 and 284 of respective nozzles 276 and 282, and may result in more uniform wetting of the tube bundle surfaces. As further shown in FIG. 23, the nozzle spray distribution, that is, both coverage area, as well as flow rate, can individually vary. In one exemplary embodiment, the angle could change along the length of the evaporator. In an exemplary embodiment, sprayed fluid may be applied to the tube bundle in both directions along the length of the evaporator. Thus, one spray area of one flow portion and a second spray area of another flow portion could combine to result in a more uniform distribution of fluid along the entire tube bundle.

Figure 26:
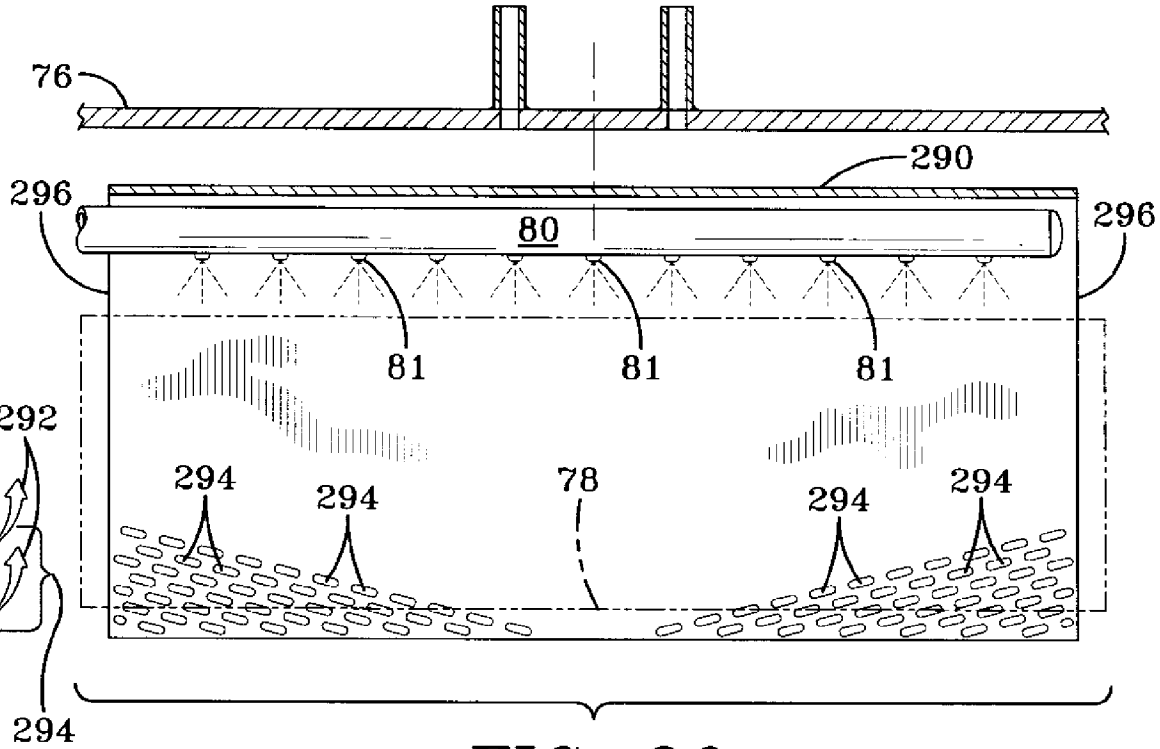
FIGS. 25 and 26 show is a cross section and an elevation end view of an exemplary embodiment of an evaporator hood.
Figure 25:
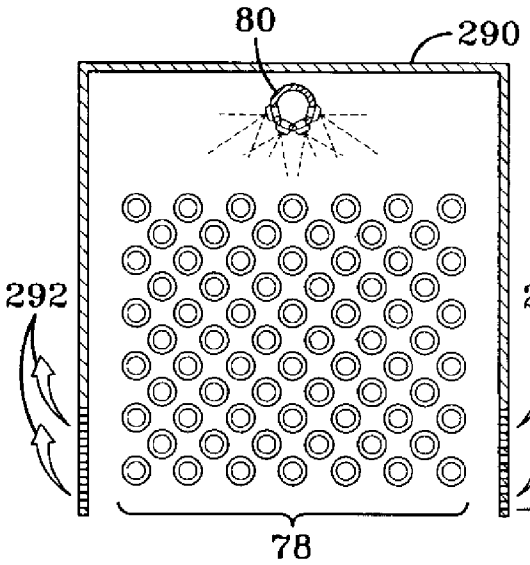

FIGS. 25 and 26 show an exemplary embodiment of a hood 290. Hood 290 includes a plurality of openings 294 formed in the surface of the hood so that an amount of refrigerant 292 can flow through the openings. In one exemplary embodiment, plurality of openings 294 may be positioned predominantly near the open end of the hood, although in another exemplary embodiment, the openings may be grouped or positioned along other portions of the hood surface. In a further embodiment, as shown in FIG. 26, a proportion of the hood surface containing plurality of openings 294 varies along the length of the hood. That is, near each end 296 of the hood, the proportion of the hood surface containing the plurality of openings 294 is increased, in comparison to portions of the hood surface that is not near the ends of the hood.

While only certain features and embodiments of the invention have been shown and described, many modifications and changes may occur to those skilled in the art (for example, variations in sizes, dimensions, structures, shapes and proportions of the various elements, values of parameters (for example, temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (that is, those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. An evaporator for use in a refrigeration system comprising:

a shell;

an outlet formed in the shell;

a plurality of tube bundles;

a plurality of hoods; and a plurality of distributors;

wherein each tube bundle of the plurality of tube bundles comprising a plurality of tubes extending substantially horizontally in the shell;

wherein at least each hood of the plurality of hoods overlies and substantially laterally surrounds substantially all of the tubes of a corresponding tube bundle of the plurality of tube bundles;

wherein each distributor of the plurality of distributors is configured and positioned to distribute fluid onto at least one tube of a corresponding tube bundle covered by a hood.

2. The evaporator of claim 1 wherein at least one hood of the plurality of hoods comprises a portion of the shell and a partition extending from the shell.

3. The heat exchanger of claim 1 further comprising a gap between adjacent hoods of the plurality of hoods, wherein the gap is configured to guide fluid exiting corresponding hoods of the plurality of hoods to the outlet.

4. The evaporator of claim 3 further comprising at least two partitions extending from the shell and separated by a gap, each partition terminating after covering a corresponding tube bundle.

5. The evaporator of claim 4 wherein each partition of the at least two partitions comprises a first segment bordering a corresponding portion of one of the corresponding tube bundles.

6. The evaporator of claim 5 wherein the first segments of the at least two partitions are configured and positioned to be substantially parallel to each other.

7. The evaporator of claim 6 wherein each partition of the at least two partitions comprises a second segment extending between and interconnecting the first segment and the shell.

8. The evaporator of claim 7 wherein the second segments are configured and positioned to be nonparallel.

9. The evaporator of claim 8 wherein the second segments are configured and positioned to diverge.

10. The evaporator of claim 9 further comprising a filter positioned between the second segments.

11. The evaporator of claim 10 wherein the filter is positioned near the outlet.

* * * * *